US005967394A

United States Patent [19]

Crowley et al.

[11] Patent Number: 5,967,394

[45] **Date of Patent: *Oct. 19, 1999**

[54] METHOD AND APPARATUS FOR PINLESS FEEDING OF WEB TO A UTILIZATION DEVICE

[75] Inventors: H. W. Crowley, Eliot; Barry M. Jackson, York, both of Me.; William F. Bolza, Chelmsford, Mass.

[73] Assignee: Roll Systems, Inc., Burlington, Mass.

[ * ] Notice: This patent is subject to a terminal disclaimer.

[21] Appl. No.: 08/632,524

[22] Filed: Apr. 12, 1996

Related U.S. Application Data

[63] Continuation-in-part of application No. 08/334,730, Nov. 4, 1994.

[51] Int. Cl.[6] ..... B65H 23/18

[52] U.S. Cl. ..... 226/31; 226/42; 226/88; 226/95; 226/111

[58] Field of Search ..... 226/2, 16, 21, 226/30, 74, 87, 28, 31, 36, 42, 88, 95, 108, 111

[56] References Cited

U.S. PATENT DOCUMENTS

| | | |
|---|---|---|
| 2,996,951 | 8/1961 | Debrie . |
| 3,209,973 | 10/1965 | Eichorn . |
| 3,466,716 | 9/1969 | Hancock et al. . |
| 3,558,109 | 1/1971 | Sofue . |
| 3,588,346 | 6/1971 | Ramig, Jr. . |
| 3,713,571 | 1/1973 | Simonton . |
| 3,858,777 | 1/1975 | Rodek . |
| 3,874,621 | 4/1975 | Blair et al. . |
| 3,921,878 | 11/1975 | Zangenfeind . |
| 4,136,808 | 1/1979 | Reba . |
| 4,297,716 | 10/1981 | Hirayama et al. . |
| 4,361,260 | 11/1982 | Hanlan . |
| 4,363,270 | 12/1982 | Ury et al. . |
| 4,461,468 | 7/1984 | Peter, III et al. . |
| 4,479,598 | 10/1984 | Mailer et al. . |
| 4,552,608 | 11/1985 | Hoffmann et al. . |
| 4,625,902 | 12/1986 | Billberg . |
| 4,655,626 | 4/1987 | Okazaki . |
| 4,693,620 | 9/1987 | Harumatsu . |
| 4,790,466 | 12/1988 | Ueno et al. . |
| 4,839,674 | 6/1989 | Hanagata et al. . |
| 4,890,140 | 12/1989 | Negoro et al. . |
| 4,945,252 | 7/1990 | Lerner et al. . |

(List continued on next page.)

FOREIGN PATENT DOCUMENTS

| | | |
|---|---|---|
| 884192 | 8/1943 | France . |
| 1436717 | 11/1968 | Germany . |

OTHER PUBLICATIONS

IBM 3900 Advanced Function Printer Maintenance Library vol. 1, SA37–0200–02, International Business Machines Corporation, 3rd Edition, Oct., 1992.

*Primary Examiner*—Donald P. Walsh
*Assistant Examiner*—William A. Rivera

[57] ABSTRACT

A system and method for utilizing web that is free of tractor pin feed holes comprises the driving of the web along a predetermined path within the utilization device. A web guide is provided in an upstream location from a utilization device element. The guide engages width-wise edges of the web and forms the web into a trough to stiffen the web. A drive roller and a follower roller impinge upon opposing sides of the web and rotate to drive the web through the guide. The drive roller is located adjacent to the guide according to a preferred embodiment. A registration controller is utilized to synchronize the movement of the web with the operation of the utilization device element. The controller includes a drive controller that controls the speed of either the drive roller or the utilization device element to maintain the web and the utilization device element in appropriate synchronization.

27 Claims, 21 Drawing Sheets

U.S. PATENT DOCUMENTS 5,012,291 4/1991 Buchan et al. .
5,037,016 8/1991 Wingerter .
5,043,904 8/1991 Sikes et al. .
5,063,416 11/1991 Honda et al. .
5,072,359 12/1991 Kneifel, II .
5,098,507 3/1992 Mao .
5,103,263 4/1992 Moore et al. .
5,123,887 6/1992 Shimura .
5,138,341 8/1992 Kobayashi .
5,193,727 3/1993 Crowley .
5,213,246 5/1993 Crowley .
5,344,057 9/1994 Crowley .
5,345,863 9/1994 Kurata et al. .
5,595,334 1/1997 Belec et al. ..... 226/15

METHOD AND APPARATUS FOR PINLESS FEEDING OF WEB TO A UTILIZATION DEVICE

RELATED APPLICATION

This is a continuation-in-part of co-pending U.S. patent application Ser. No. 08/334,730, filed Nov. 4, 1994.

FIELD OF THE INVENTION

The present invention relates generally to a method and apparatus for transferring tractor pin feed hole-free web to and from a utilization device normally adapted to drive web using a tractor pin feed arrangement.

BACKGROUND OF THE INVENTION

In high volume printing applications, laser printers such as the IBM® 3800™ and 3900™ series, as well as the Siemens® 2140™, 2200™, and 2240™ series, lay down images on a continuous web by directing the web through an image element, that, typically, comprises a moving image drum having toner deposited thereon. A portion of such a web 12 is illustrated in FIG. 1. The feeding of the web 12 to the image drum is facilitated by one or more "tractor pin" feed units that engage evenly spaced holes 14 disposed along opposing widthwise edges of the web on "pin feed" strips 16. The widthwise edges having "tractor pin feed holes" therein, as well as the sheets themselves often include perforations 17, 18, respectively, for easy removal.

A typical pin feed application is depicted in FIG. 2. A source 20 of continuous web 22 is driven (arrow 24) to an image transfer element 26 of a printer 28. Toner 30 is provided to the image transfer element or drum 26 by operation of the optical print head 32. A separate developer 34 is provided to attract the toner to the drum 26. The web 24 engages the image drum 26 at a transfer station 36 where printing is laid upon the web as it passes over the image drum 26. The image drum rotates (arrow 38) at a speed matched to the speed of web travel. The web 24 is driven to and from the image drum 26 by a pair of tractor units 40 and 42 that each include a plurality of pins 44 on moving endless tractor beds 45 for engaging pin holes in the edges of the web. The pin holes 14 are moving endless tractor beds 45 for engaging pin holes in the edges of the web. The pin holes 14 are detailed in FIG. 1 discussed above.

Downstream of the tractor feed units 40 and 42, the web 24 is directed over a fuser 46 and a preheat unit 48 that fixes the toner to the web 24. The web is subsequently directed to a puller unit 50 that comprises a pair of pinch rollers and into a director chute 52 onto a stack of zigzag folded finished web 54.

A significant disadvantage of a printer arrangement according to FIG. 2 is that the additional inch to inch and one half of web that must be utilized to provide the tractor feed hole strips entails significant waste. The web area between the tractor feed pin hole strips already comprises a full size page and, thus, the tractor feed strips represent area having no useful function other than to facilitate driving of the web into the printer. In a typical implementation, the pin holes are subsequently torn or cut off and disposed of following the printing process.

A variety of utilization devices currently employ tractor pin feed continuous web. Such a feed arrangement is a standard feature on most devices that utilize more than 80 pages per minutes. Specialized equipment has been developed to automatically remove tractor pin feed strips when they are no longer needed. Hence, substantial cost and time is devoted to a web element that does not contribute to the finished appearance of the completed printing job. However, such tractor pin feed strips have been considered, until now, a "necessary evil" since they ensure accurate feeding and registration of web through a utilization device.

It is, therefore, an object of this invention to provide a reliable system for feeding continuous web through a utilization device that does not entail the use of wasteful edgewise strips having tractor pin feed holes.

It is another object of this invention to provide a system and method for feeding web that ensures accurate registration of the web with other moving elements of a utilization device and enables web to be directed to a variety of locations.

SUMMARY OF THE INVENTION

This invention relates to a system and method for utilizing web that is free of tractor pin feed holes. The system and method comprise the driving of the web along a predetermined path within the utilization device. A web guide is provided in an upstream location from a utilization device element. The guide engages width-wise edges of the web and forms the web into a trough to stiffen the web. A drive roller and a follower roller impinge upon opposing sides of the web and rotate to drive the web through the guide. The drive roller is located adjacent to the guide according to a preferred embodiment. A registration controller is utilized to synchronize the movement of the web with the operation of the utilization device element. The controller includes a drive controller that controls the speed of either the drive roller or the utilization device element to maintain the web and the utilization device element in appropriate synchronization.

In a preferred embodiment, the web guide can comprise tractor pin feed drive assemblies in which the tractor pins include plates that overly the tractor pins. In such an embodiment, web is held in place along its width-wise edges by the overlying plates and is retained against side-to-side movement by the tractor pins. The tractor pins engage the outer edges of the web (rather than holes formed in the edges of the web) and form the web into a trough that provides substantial beam strength to the web and enables accurate guiding of the web through the utilization device element. The drive roller can be located offset from a plane formed by the tractor pin belts to facilitate the formation of the trough.

The drive roller can be interconnected with the tractor pin feed drive element and operate in synchronization therewith. The follower roller of the drive roller can be provided with a pivotal bracket that allows the follower roller to be moved into and out of engagement with the drive roller so that web can be easily loaded onto the utilization device.

The utilization device element can comprise a rotating image drum according to a preferred embodiment and the utilization device can comprise a printer or copier adapted to feed continuous web. The registration controller, similarly, can comprise a sensor that senses a selected mark on the web such as a preprinted mark or a perforation. The controller can be adapted to scan for a mark at a selected time interval and modify the speed of the drive roller based upon the presence or absence of such a mark.

According to a preferred embodiment, the drive motor can include an advance and retard mechanism that is responsive to the controller to maintain the driven web in synchronization with the utilization device element. A registration drive motor and a differential gearing system can be provided to enable advancing and retarding of the drive roller. The drive element can comprise a harmonic drive differential.

The upper, downstream, tractor pin feed assembly of this invention can include a vacuum belt drive that prevents slippage of pinless web under tension applied by various components of the utilization device.

While the term "drive roller" is utilized according to this embodiment, it is contemplated that a variety of different driving mechanisms that enable advancing of a web to a utilization device element can be utilized according to this invention. It is of primary significance that such devices be capable at advancing a web that is free of tractor pin feed holes along the edges thereof or otherwise thereon. For example, a drive belt or belts can be substituted for the drive roller and the word "roller" is particularly contemplated to include such a belt or belts. Similarly, the drive can comprise a full-width roller or reciprocating foot or shoe that advances the web in selected increments.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION

Figure 3:
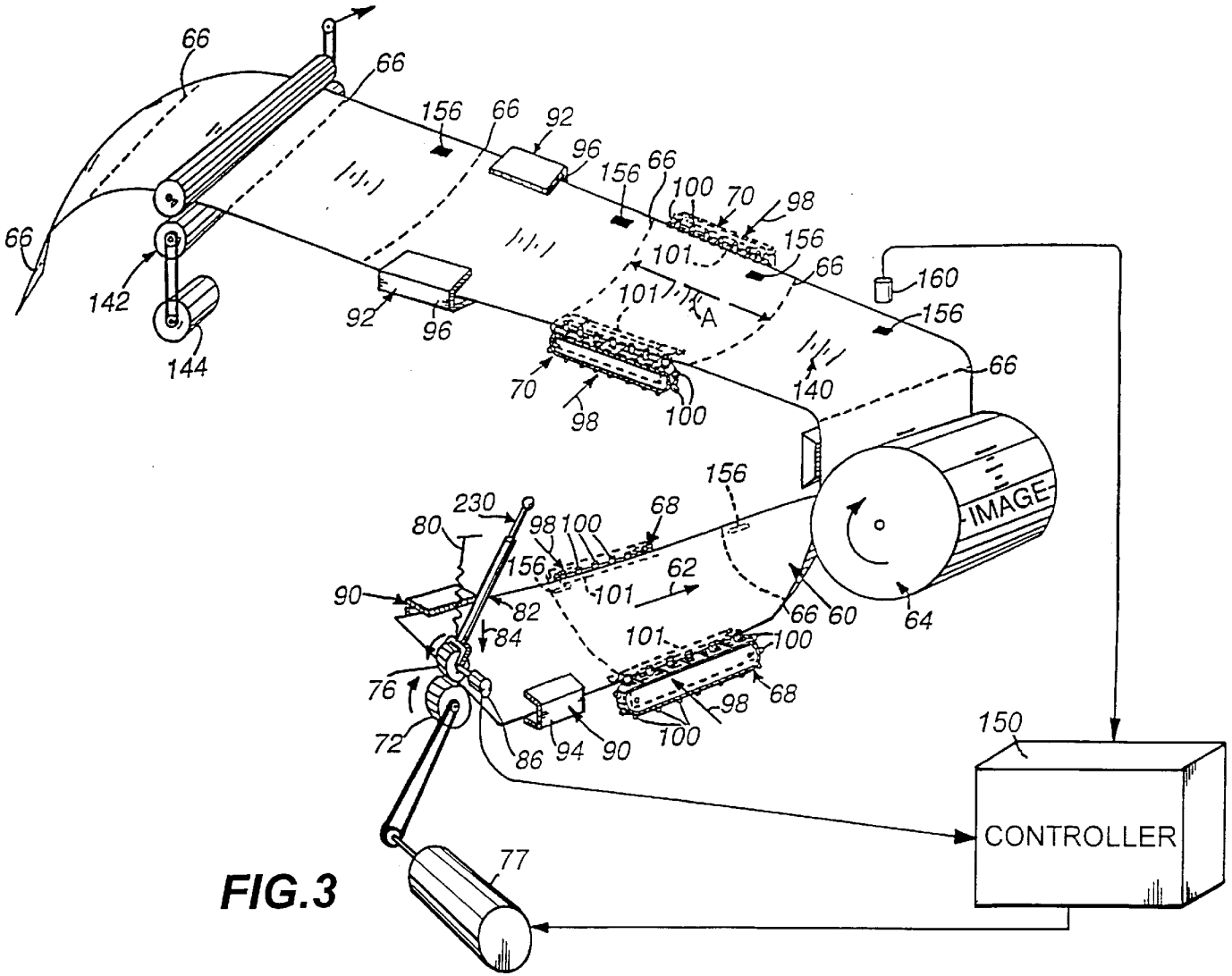
FIG. 3 is a schematic perspective view of a pinless web feed system according to a preferred embodiment.

A system for feeding web to a utilization device image drum, without use of tractor pin feed holes, is depicted in FIG. 3. A web 60 is shown moving in a downstream direction (arrow 62) to an image transfer drum 64 of conventional design. The web 60 according to this embodiment can include perforations 66 that define standard size sheets therebetween. A distance A separates the perforations 66. For the purposes of this discussion, A shall be taken as a standard page length of 11 inches, but any suitable dimension for both length and width of sheets is expressly contemplated.

Note that perforations are optional and that an unperforated plain paper web is also expressly contemplated according to this invention. Printed sheets can be subsequently separated from such a continuous web by a cutter (not shown).

As noted above, virtually all high speed printers and web utilization devices have heretofore required the use of tractor pin feed systems to insure accurate feeding of continuous web through the utilization device. Since pin holes are provided at accurate predetermined locations along the edges of a prior art continuous web, the web is consistently maintained in registration with the moving is elements of the utilization device. This is particularly desirable when a moving image drum is utilized, since any error in registration has a cumulative effect and causes substantial misalignment of the printed text upon the web. The misalignment may, over time, cause the text to overlap onto an adjoining sheet.

Accordingly, to provide an effective feeding system for utilization devices, a suitable replacement for each of the driving, guiding and registration functions normally accomplished by the tractor pin feed system is desirable. The embodiment of FIG. 3 represents a system that contemplates alternatives to each of the functions originally performed by the tractor pin feed system.

As detailed in FIG. 3, the web 60 lacks tractor pin feed strips. While not required, according to this embodiment the tractor pin feed drive elements 68 and 70 have been retained. Actual driving is, however, accomplished by a drive roller 72 located at the upstream ends of the image drum 64. The drive roller 72, according to this embodiment, is propelled by a belt-linked drive motor 77. The motor 77 can comprise a suitable electric drive motor having speed control capabilities. Alternatively, the motor (not shown) utilized for operating the tractor pin feed drive elements 68 and 70 can be employed, via appropriate gearing, to drive the drive roller 72.

The drive roller 72 can comprise a polished metallic roller that bears against a side of the web 60. The drive roller 72 can have a width of approximately one inch or more and should generate sufficient friction against the web 60 to ensure relatively slip-free drive of the web 60. Wider labels, narrower roller or a plurality of rollers is also contemplated.

In order to enhance the frictional engagement of the wheel 72 with the web 60, a follower roller 76 is provided. The follower roller 76 bears upon an opposing side of the web 10 to form a pinch roller pair. The follower roller, according to this embodiment, includes a spring 80 that pressurably maintains (arrow 84) the follower roller 76 against the web 60 and drive roller 72 via a pivotal mounting bracket 82. The pressure should be sufficient to ensure that an appropriate driving friction is generated by the drive roller 72 against the web. The follower roller 76 can include an elastomeric wheel surface for slip-free movement relative to the web 60. Since the follower roller 76 rotates relative to the web in relatively slip-free engagement, the roller 76, according to this embodiment is interconnected with an encoder 86 or other sensor that generates appropriate electronic signals in response to a predetermined arcuate movement. Such arcuate movement can be is translated into a relatively precise indication of the length of web passing through a corresponding drive element. The follower roller 76, thus, can be utilized as a registration mechanism. The encoder functions and the operation of this registration mechanism is described further below.

Since the tractor pin feed drives 68 and 70 are typically located substantially adjacent a given utilization device element (such as the drum 64), the tractor pin feed drives 68 and 70 normally provide sufficient guiding to ensure that the web is accurately aligned with the utilization device element (drum 64) in a conventional pin feed configuration. Such guiding results, in part, from the forced alignment of the web at its widthwise edges. Alignment is facilitated by the synchronous movement of pins at each side of the web and the fact that the pin feed drive members are typically elongated so that several pins engage each edge simultaneously. However, absent such forced alignment (in, for example, a pinless feed configuration), the natural flexibility of a web would tend to cause skewing and buckling at the utilization device element (image drum 64 in this embodiment).

In some circumstances, it may be possible to locate the drive roller 72 immediately adjacent the utilization device element (64) to reduce the risk of buckling in a pinless drive. However, this may prove impractical or impossible in many utilization devices due to space limitations or, Accordingly, an alternative approach for guiding the web adjacent each of the drive elements 72 and 76 is provided according to this invention. Applicant's U.S. Pat. No. 4,909,426 (the teaching of which is expressly incorporated herein by reference) discloses a method and apparatus for guiding web that utilizes the natural beam strength of paper or other web material when formed into a trough with restrained side edges. In other words, by drawing the side edges of an elongated web toward each other so that the distance between the edges is less than the unbent width of the web, causes the web to form a trough that becomes rigid and resists buckling and lateral (side to side) movement. As such, the web can be driven effectively with accurate alignment downstream of the drive element.

Edge guiding according to this embodiment is provided by pairs of guide channels 90 and 92 located upstream and downstream of the image drum 64. The pairs of channels 90 and 84 are located so that end walls 94 and 96 are spaced from each other a distance that is less than the width of the unbent web. Accordingly, the web assumes a trough shape as depicted generally by the perforation lines 66. As noted above, the trough shape generates a beam-like characteristic in the web that maintains the edges in rigid alignment for introduction to the image drum 64. The channels 90 and 92 can be replaced with other structures having end walls such as a full trough.

The channels 90 or other guide structures are typically located adjacent the drive and follower rollers 72 and 76 to ensure the web remains aligned as it is driven. The guide structure can extend downstream to a location substantially adjacent the image drum. It is desirable that the web 60 be maintained relatively flat as it passes into the image drum 64 (or other utilization device element) so that the drum 64 can fully engage the web. If a full trough guide structure is utilized adjacent the drive and follower rollers 72 and 76 it is contemplated that an orifice (not shown) can be provided to enable the web to be engaged by the drive and follower rollers 72 and 76.

Even though the existing tractor pin feed drive elements 68 and 70 are not utilized according to this embodiment to effect drive of the web, these pin feeds drives can themselves accomplish the edge guide function. Most printer units such as the IBM® 3900™ series (statistics for which are available in IBM® 3900™ Advanced Function Printer Maintenance Library, Vol 5 1–4, Third Edition (October 1992), SA37-0200-02) and the Siemens® 2200™ and 2240™ systems utilize pin feed drive elements that are movable toward and away each other (arrows 98) to ensure proper engagement of tractor pin feed drive elements with a given width of web. For example, the user engagement of tractor pin feed drive elements with a given width of web. For example, the user may wish to switch from standard 8½"×11" sheets to A4 standard sheets. According to this embodiment, each individual tractor pin feed drive element can be moved toward the other (arrows 98) until the pins 100 bear against the edges of the web. The pins can be moved so that their spacing from each other forms the desired trough shape in the web 60 (e.g., the distance of the wide edges of the opposing sets of pins from one another is less than the free width of the web. Since most tractor pin feed drive elements also include an overlying guide plates 101 (shown in phantom) the edges of the web 60 are restrained against upward movement when the web is formed into the trough shape.

Figure 4:
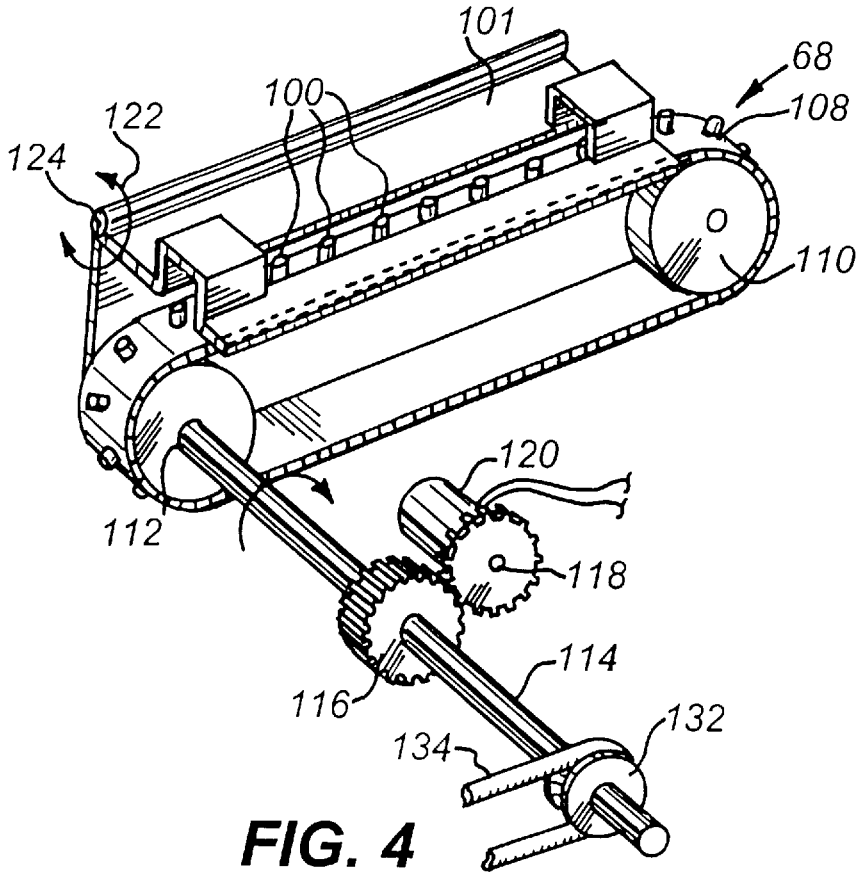
FIG. 4 is a somewhat schematic perspective view of a tractor pin feed element and drive mechanism according to this invention.

As further illustrated in FIG. 4, the exemplary tractor pin feed drive element 68 comprises an endless tractor belt 108 having the pins 100 projecting therefrom. The belt 108 is disposed between a pair of rollers 110 and 112. At least one of the rollers 112 is driven by a drive shaft 114 that can comprise a hexagonal cross-section drive shaft. A gear 116 is attached to the shaft 114 and engages a drive gear 118 that is interconnected with a drive motor 120. The drive motor can comprise a central drive motor that powers both tractor pin feed elements 68 and 70 according to this embodiment. In addition, as described further below, the drive motor arrangement can include an encoder that measures web of movement through the tractor pin feed drive elements.

As noted above, each tractor pin feed drive element 68 and 70 includes an overlying guide plate 101 that pivots (curved arrow 122) on an axis 124. This enables the guide plate 101 to be positioned adjacent and remote from the tractor pin feed belt 108 for loading and unloading of web.

Figure 5:
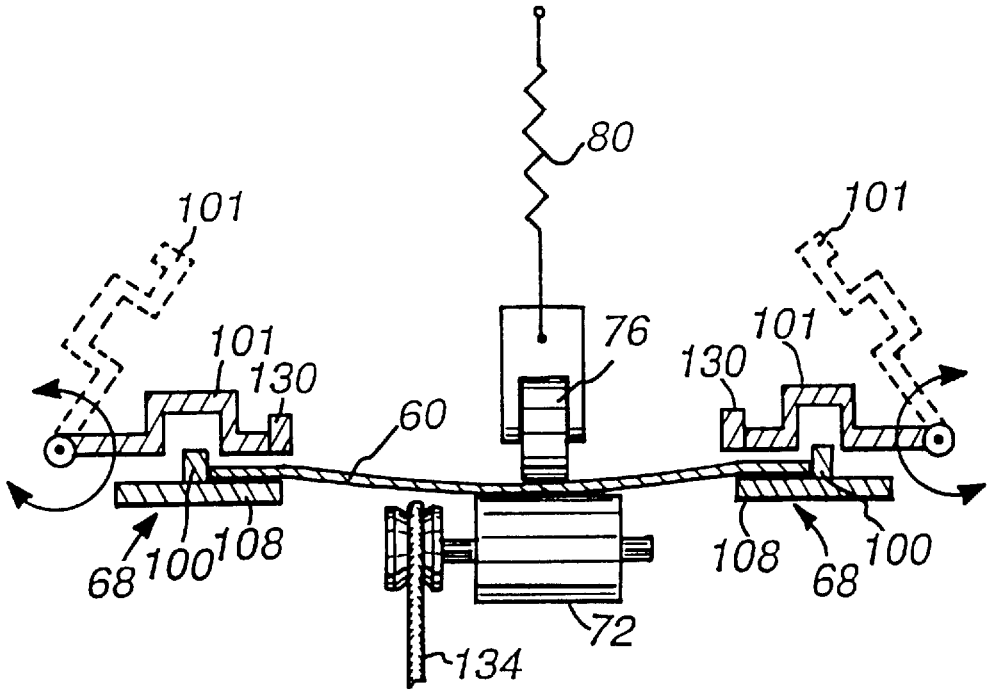
FIG. 5 is a somewhat schematic cross-section of a web positioned between the tractor pin feed elements according to this embodiment.

As further detailed in FIG. 5, each side of the tractor pin feed drive element 68, according to this embodiment, can be moved toward the other so that the web 60 forms a slight trough. Only a relatively small deflection in the web is necessary to ensure adequate beam strength. In this embodiment, the drive roller 72 is positioned approximately 0.025–0.030 inch below the plane formed by the tractor pin feed belts 108 to facilitate creation of the trough shape in the web 60.

It can be desirable in certain printer units such as the IBM® 3900™ series to extend the inwardly-directed length of the guide plates 101 to ensure proper edge restrain of the web 60. Thus, additional edge guides 130 are attached to each guide plate 101. These edge guides extend substantially the complete length of the guide plate in an upstream-to-downstream direction and have an inwardly directed width of approximately ¼ inch.

The blocks 130 are typically recessed approximately 0.020 inch above the lower face of the plates 101. Additionally, the blocks may include upwardly curving upstream edges. This configuration insures that the leading edge of a web will pass under the plates 101 during initial loading of the utilization device.

With further reference to FIG. 4, a pulley 132 can be provided to the drive shaft 114. The pulley 132 drives a belt 134 that can be interconnected with the drive roller 72 (FIG. 5) to facilitate driving of the drive roller 72 utilizing the existing tractor pin feed drive motor arrangement. Appropriate brackets can be provided to mount the drive roller 72 with respect to the underside of the web 60 as shown in FIG. 5.

Since the tractor pins 100 move on their respective belts 108 at a speed that substantially matches that of web travel through image drive 64 (via drive rollers 72, 76), the tractor pin feed drive elements 68 and 70 follow web movement and, thus, provide a relatively low-friction guiding mechanism. It is contemplated that most drive energy is still provided by the additional drive and follower rollers 72 and 76. As noted above, these drive elements 72 and 76 can be interconnected with the drive train of tractor pin feed units in some embodiments. Additionally, the use of tractor pin drives as guiding elements presumes that such elements are preexisting and that the pinless drive mechanism is a retrofitted installation to a utilization device.

Drive of the web 60 according to the prior art involves the use of two pairs of tractor pin feed drive assemblies 68 and 70 as depicted. However, the downstream tractor pin feed drive element 70 cannot easily be replaced with a drive member such as upstream drive roller 72. The text 140 transferred from the image transfer drum 64 is not yet fused to the web 60. Thus, applying a centralized drive roller to the web could potentially smudge or damage the image on the web. Additionally, it is desirable to enable printing across the entire width of a sheet, thus, edge rollers can be undesirable. While in some utilization device, a downstream drive roller can be provided without damaging the web, it is contemplated that downstream draw of the web according to this embodiment is regulated primarily by the fuser rollers 142 that simultaneously draw the web 60 and apply heat to fuse the image to the web 60. The downstream tractor feed drive element 70 is retained primarily for edge guiding of the web.

Figure 1:
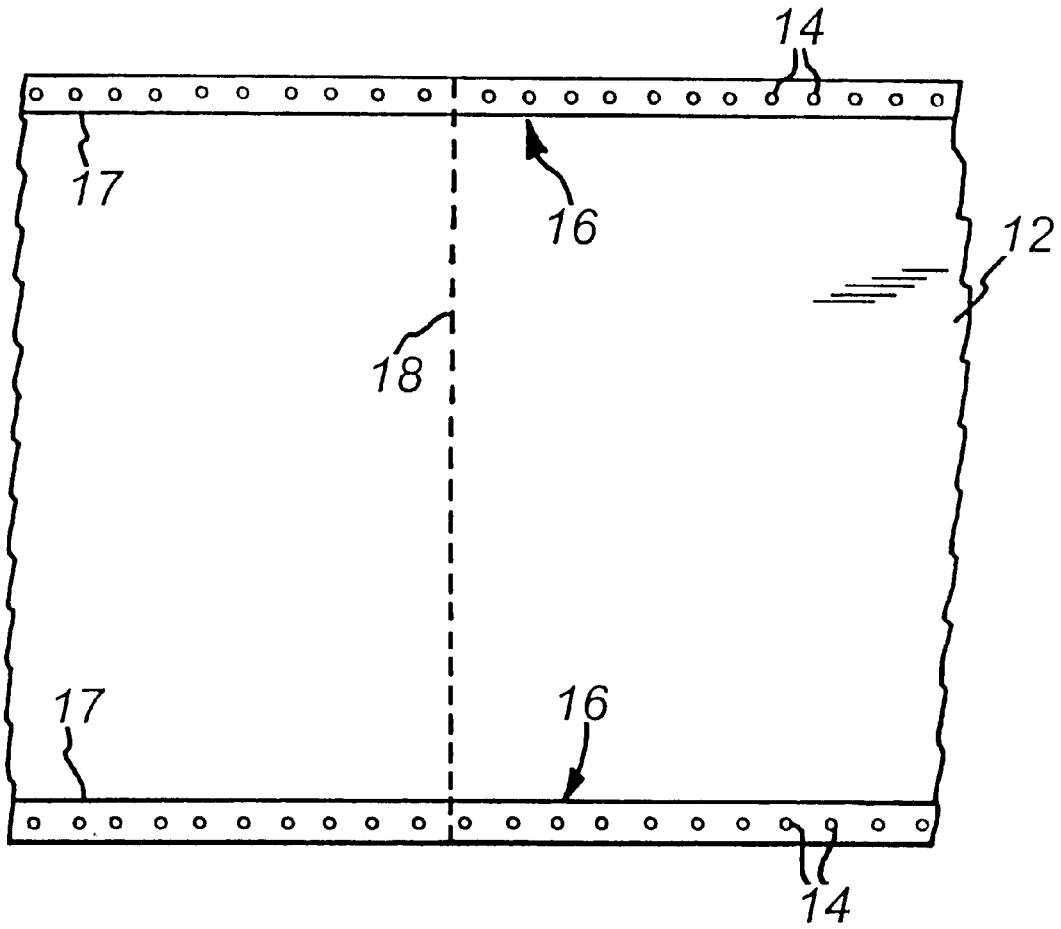
FIG. 1 (PRIOR ART)
FIG. 1 is a somewhat schematic plan view of a portion of a continuous web having pin feed strips according to the prior art.
Figure 2:
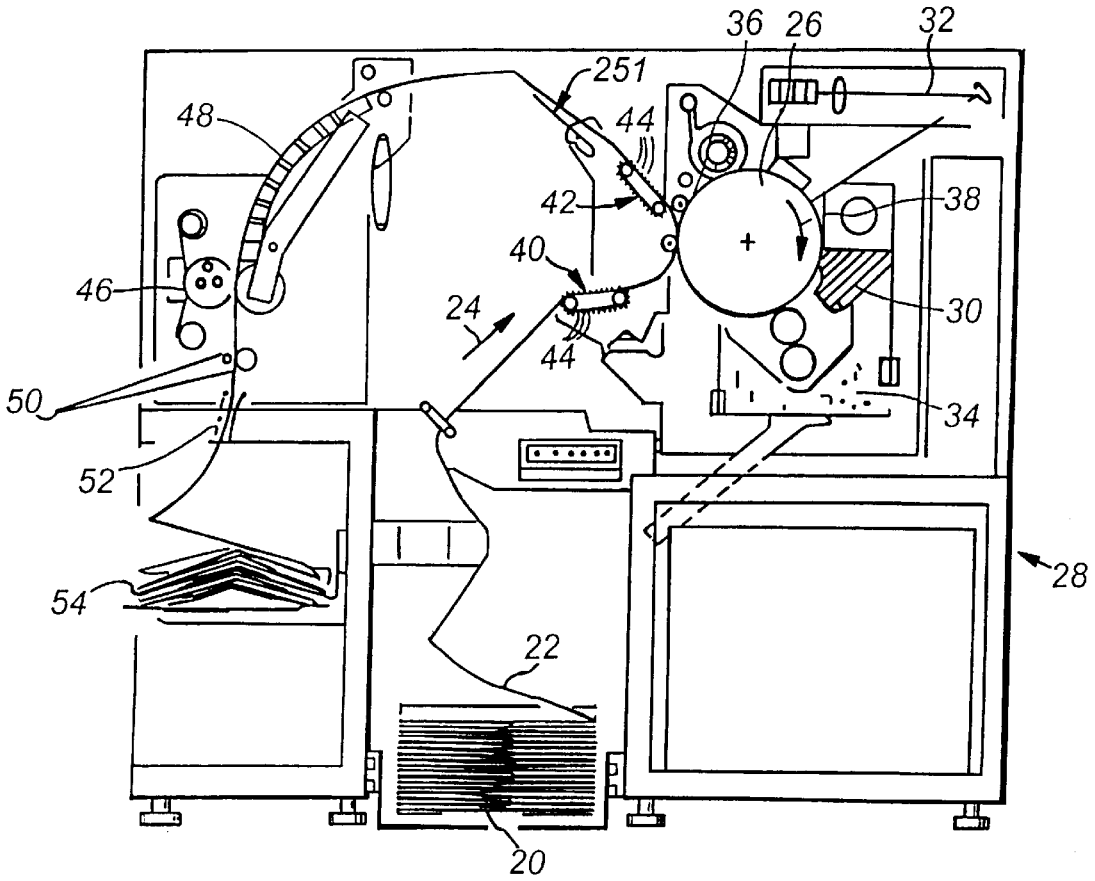
FIG.2 (PRIOR ART)
FIG. 2 is a somewhat schematic side view of a printer that utilizes continuous web having tractor pin feed drive members according to the prior art.

In the majority of utilization devices such as the IBM® 3900™ series printer, the speed of the fuser rollers is governed relative to the speed of the image transfer drum 64. In many units, a dancer roll pivotally engages the web at a point of free travel where slack can form. The pivot of the dancer 251 shown for example in FIG. 2 is located adjacent the downstream tractor pin feed drive assembly 70. The dancer roll includes a speed control that is interconnected with the drive motor 144 of the fuser rollers 142. According to this embodiment, speed control of the fuser roller 142 is typically effected by a dancer roll or by sensing of a predetermined mark on the web. The use of such marks is described further below. Many utilization devices track the passage of the pin holes to govern speed. However, the absence of pin holes according to this embodiment necessitates of an alternate form of sensor.

Having provided an effective mechanism for both driving and guiding the web without use of tractor pin feed holes, there remains the provision of appropriate registration of the web 60 as it passes through the utilization device element. In a prior art tractor pin feed embodiment, as noted above, registration is provided naturally by the regular spacing of tractor pin feed holes along the web and the synchronization of the pin feed drive elements with the utilization device element. Absent the existence of pin holes on the web, some degree of slippage and variation in sheet length naturally causes misregistration of the web relative to the utilization device element over time. Hence, while a web may initially enter an image transfer element in perfect registration, the downstream end of the web could be offset by a half page or more causing text to be printed across a page break by completion of a large job.

Thus, registration of web relative to the utilization device element, according to this embodiment, involves the use of a mechanism that continuously determines the location of the web relative to the utilization device element (image transfer drum 64). As discussed above, the existing tractor feed drive (FIG. 4) or, alternatively, the follower roller 76 includes an encoder that generates pulses based upon passage of web 60 through the image transfer drum 64. 60 pulses per inch is a commonly-web standard. FIG. 3 illustrates a controller 150 that receives pulses from the encoder 86 on the follower roller 76 (or pin feed drive element 68, 70 drive train).

Figure 6:
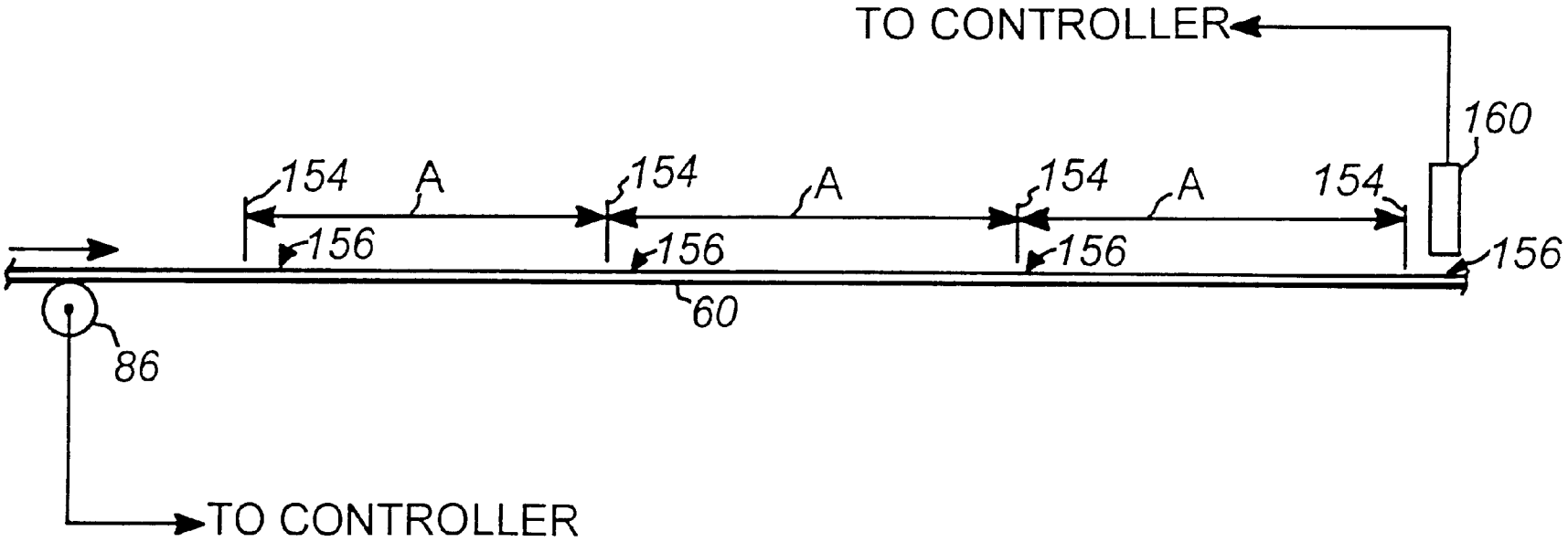
FIG. 6 is a schematic side view of a web registration system according to the preferred embodiment.

With further reference to FIG. 6, the pulses generated by the encoder 86 can be calibrated by the controller 150 to track the passage of the wells length A of web 60 thereover. As long as the web 60 remains synchronized with the image drum 64, a given length A of web bounded by page breaks 154 should pass over the image drum in synchronization with the image delivered thereon. If, however, the length passing over the image drum is greater than or less than A, the web 60 will slowly become offset relative to the printed image. Such offset can be cumulative and radially skew the printing on the web.

As noted, prior art printers avoided much of the problem associated with cumulative offset by using the regularly spaced tractor pin feed holes as a guide that insures alignment of the web with the image drum. However, the pinless drive roller 72 may cause minor web slippage. Thus, to insure the registration of the web 60 relative to the image drum 64 is maintained, regularly spaced preprint marks 156 (FIG. 3) are provided at predetermined intervals along the web. These regularly spaced marks 156 can comprise visible or invisible marks. It is necessary only that the marks be sensed by some accepted sensing mechanism. For example, infrared or UV sensitive marks can be utilized. Similarly, notches or perforations can be utilized as marks. The marks can be spaced relative to each page break or at selected multiples of page breaks, so long as the marks are spaced in a predictable pattern that indicates a relative location on the web.

A sensor 160, which in this embodiment is an optical sensor, is interconnected with the controller 150 and is programmed to sense for the presence of the preprinted mark 156 at a time that correlates to the passage of page length A through the image transfer drum 64. If the mark 156 is sensed, the current drive roller speed is maintained. However, if the mark is no longer sensed, the speed is increased or decreased until the mark 156 is again sensed for each passage of a page length A of web 60 through the image drum 64.

In operation, the controller 150 continuously receives encoder pulses from the encoder 86. When a number of pulses are received that correlates to a page length A the controller queries the sensor 160 for the presence or absence of a mark 156. Absence of mark, triggers an incremental increase or decrease in drive roller speed until the mark 156 again appears at the appropriate time. In order to insure that any increase or decrease in speed in appropriately made as required, the sensor 160 can be programmed to strobe at, for example, 60 cycles per second to determine the almost exact time of passage of a mark relative to the timing of the passage of a length A of web through the image drum 64. Hence, if the strobed sensor senses that the mark 156 has passed before the passage of a length of web, the drive roller 72 can be instructed speed up. Conversely, if the mark 156 is sensed subsequent to the passage of a length of web through the image drum 64, then the drive roller 72 can be instructed to slow. Since feed using a drive roller 72 according to this embodiment is relatively reliable and slip-free, the speed-up and slow-down functions can occur in relatively small increments (such as a few hundredths or thousandths of an inch per second). An effective method for tracking web is disclosed in Applicant's U.S. Pat. Nos. 4,273,045, 4,736,680 and 5,193,727, the disclosures of which are expressly incorporated herein by reference. With reference to U.S. Pat. No. 5,193,727, a method and apparatus for tracking web utilizing marks on the web is contemplated. These marks enable the determination of page breaks despite the existence of slack in the web.

Figure 7:
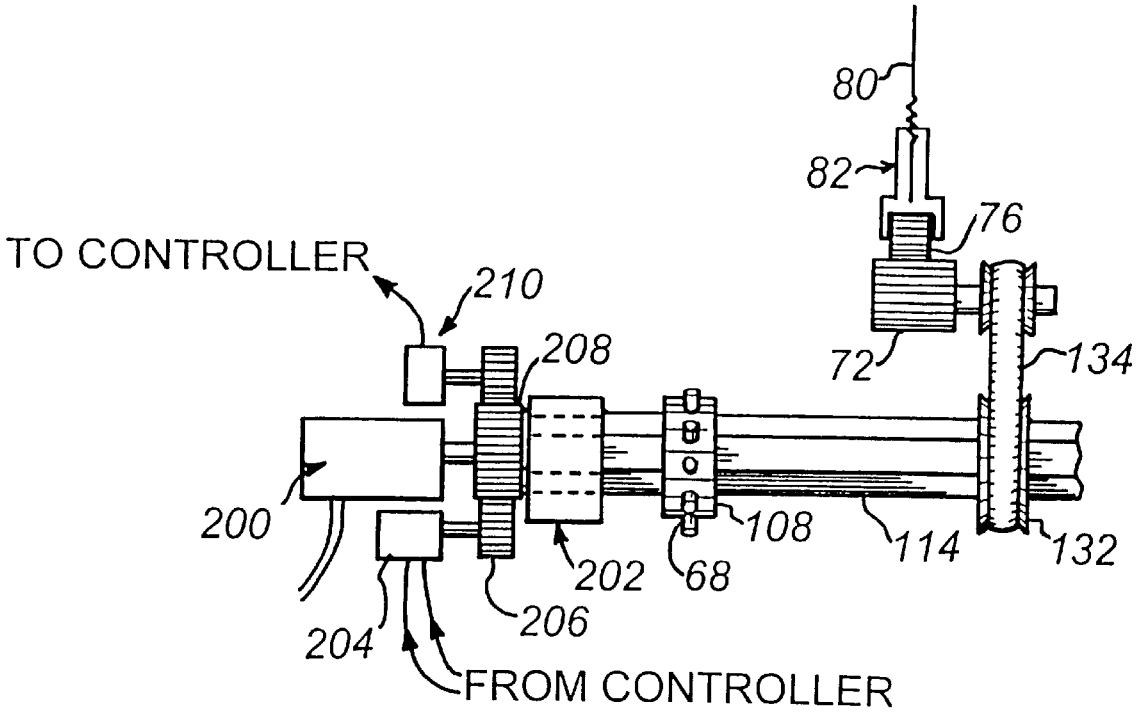
FIG. 7 is a somewhat schematic side view of a registration mechanism according to an embodiment of this invention.

As discussed above, the drive roller 72 can be interconnected with the tractor pin feed drive shaft 114 via a pulley 132 and belt 134 interconnection. FIG. 7 illustrates a registration controller that interacts with the drive shaft 114. Thus, the existing tractor pin feed drive motor and mechanism can be utilized according to this embodiment. The drive feed motor 200 is interconnected with the drive shaft 114 via a differential unit 202 that, according to this embodiment, can comprise a Harmonic Drive differential that enables concentric application of main drive force and differential rotation. Harmonic Drive gearing utilizes inner and outer gear teeth that differ in number. The inner oscillates relative to the outer to provide a slow advance or retard function. Such gearing typically offers ratios of 50:1 to 320:1. Thus, for a given rotation applied by the main motor 200, a relatively small rotational correction can be applied by the differential motor 204. Other forms of differentials are also contemplated. In the illustrated embodiment, the differential drive motor 204 is interconnected by gearing 206 and 208 that is interconnected with the differential 202. The differential motor drive 204, according to this embodiment, receives drive signals from the controller that enable forward and reverse drive of the differential drive motor 204. The differential 202 responds to such forward and reverse drive signals by advancing or retarding the drive shaft relative to the main drive motor 200. Hence, small incremental changes in web location relative to the movement of the image transfer drum can be effected using the differential 202 according to this embodiment.

As previously discussed, signals instructing advance and retard of the main drive roller can be provided based upon the location of predetermined marks on the web relative to the passage of a given length of web through the image transfer drum. Thus, an encoder 210 is interconnected with main drive motor 200 via gear 208. The encoder 210 can comprise the original encoder used with the printer drive mechanism. Similarly, an internal encoder can be provided in the main drive motor 200.

Figure 8:
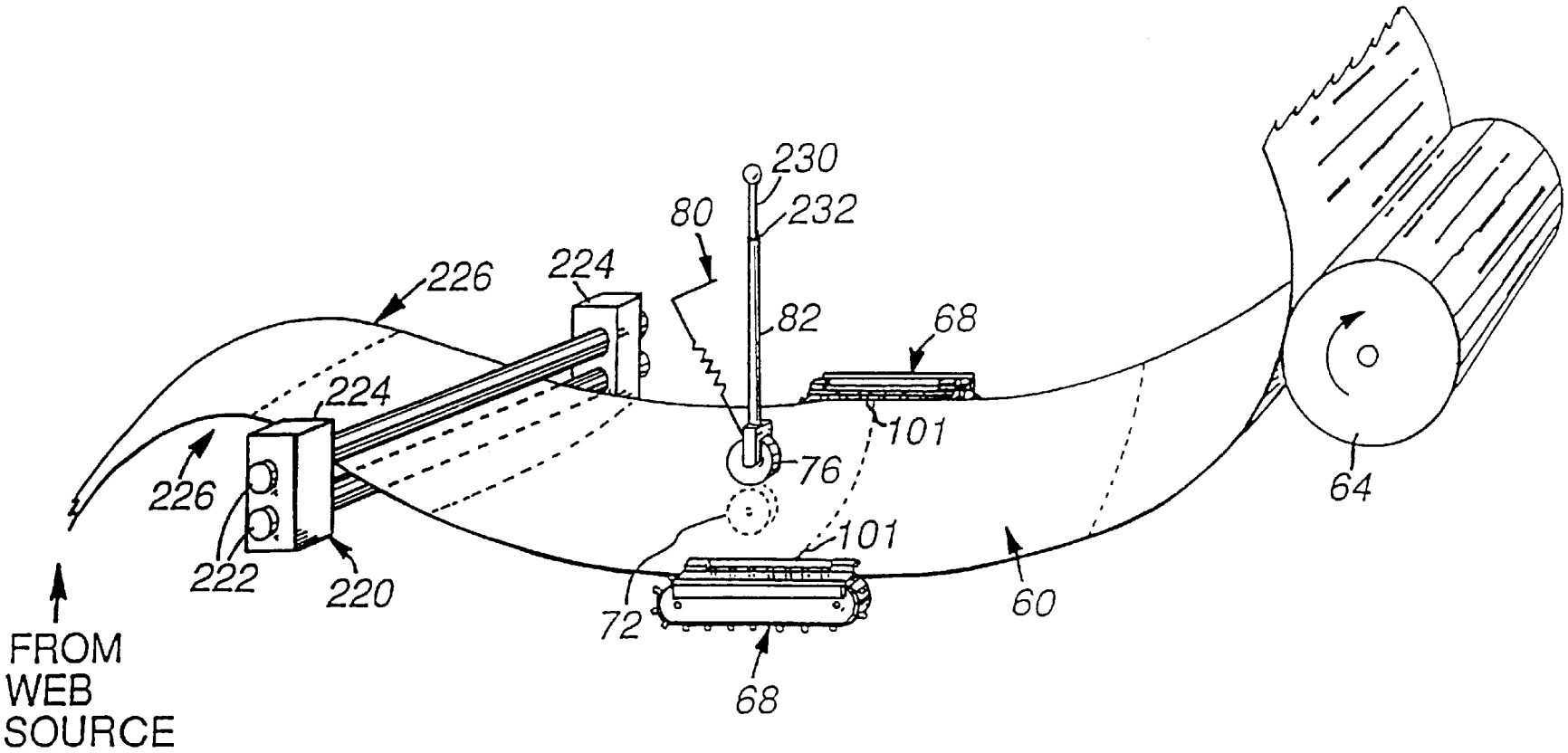
FIG. 8 is somewhat schematic perspective view of an improved guiding system according to this invention.
Figure 9:
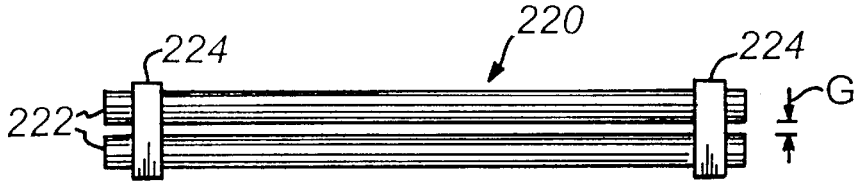
FIG. 9 is a front view of an improved guide according to FIG. 8.

A further improvement to the guiding function according to this invention, as illustrated in FIGS. 8 and 9, entails the use of a stiffener bar assembly 220 upstream of the drive roller 72 and upstream tractor pin feed drive element pair 68. The stiffener bar assembly 220 according to this embodiment can be located approximately 3–12 inches from the drive roller 72 and can be mounted on brackets (not shown) that extend from the tractor pin feed drive element 68. The stiffener bar assembly comprises a pair of round cross-section rods 222 having a diameter of approximately ½–¾ inch. The rods 222 are mounted in a spaced-apart parallel relationship on a pair of mounting blocks 224 that are located outwardly of the edges of the web 60. The blocks 224 should be mounted so that clearance is provided for the widest web contemplated. The blocks 224 can be spaced an additional inch or more beyond the edges 226 of the web 60. As detailed in FIG. 9, the blocks 224 separate the rods 222 by a gap G that, according to this embodiment, is approximately 0.015 inch. Hence, the gap G is sufficient to allow passage of most thicknesses of web therebetween, but allows little play in the web 60 as it passes through the bars 222. The bar assembly 220 thus aids in the prevention of buckling of the web 60 as it is driven to the drive roller is 72.

According to this embodiment, the web 60 is threaded through the bars 222 upon loading since the bars are fixed relative to each other. It is contemplated that rod pair can be employed to facilitate loading and to accommodate different thickness of web.

Note that loading of web into the system is also facilitated by a handle 230 located upwardly of the pivot axis 232 of the follower roller bracket 82. The handle enables the user to move the follower roller 76 out of engagement with the upper side of the web 60 to facilitate loading. As discussed above, the overlying plates 101 of the tractor pin feed drive element 68 can also be lifted to allow the web to be positioned onto the tractor pin feed drive element 68.

Figure 10:
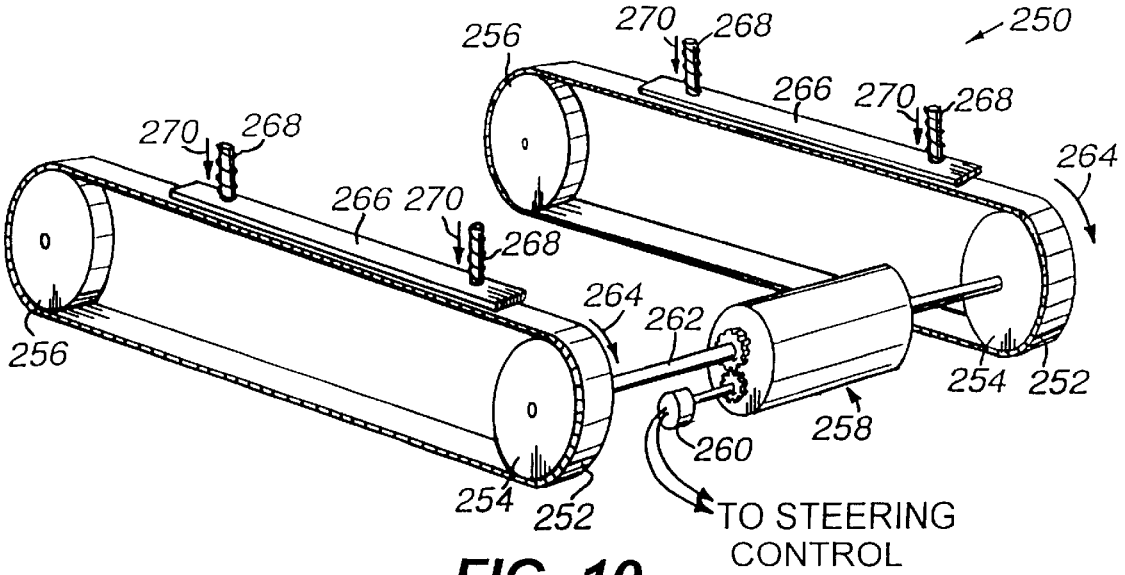
FIG. 10 is a somewhat schematic perspective view of an alternate embodiment of a web s driving and guiding mechanism according to this invention.

It is further contemplated, according to this invention, that the driving and guiding functions can be combined into a single drive/guide unit. FIG. 10 illustrates a driving and guiding unit 250 that comprises a pair of elastomeric belts 252 that are, in this embodiment, fitted over the rollers 254 and 256 of the tractor feed drive elements found in a conventional utilization device. It is further contemplated that the tractor feed pin belts can be retained (not shown) and that the elastomeric belts 252 can be positioned directly over these tractor pin feed belts.

While guiding can still be provided by a separate structure, it is contemplated that, according to this embodiment, a steering differential drive assembly 258, such as the harmonic drive described above, having a differential drive motor 260, is employed in conjunction with the belt drive shaft 262. Thus, the belts are normally driven in synchronization in the direction of the arrows 264 but application of rotation by the differential drive motor 260, in a predetermined direction, causes the belts to move differentially relative to each other to effect steering of a driven web.

According to this embodiment, a respective pressure plate 266 is located over each of the belts 252. The pressure plates include springs 268 that generate a downward force (arrows 270) to maintain the web (not shown) in positive contact with the belts. The pressure plates can comprise a polished metal or similar low friction material. It is contemplated that the conventional tractor pin feed plates described above can be adapted to provide appropriate pressure against the belts 252.

Alternatively, the plates can be used as mounting brackets for supplemental pressure plates such as the plates 266 described herein.

Figure 11:
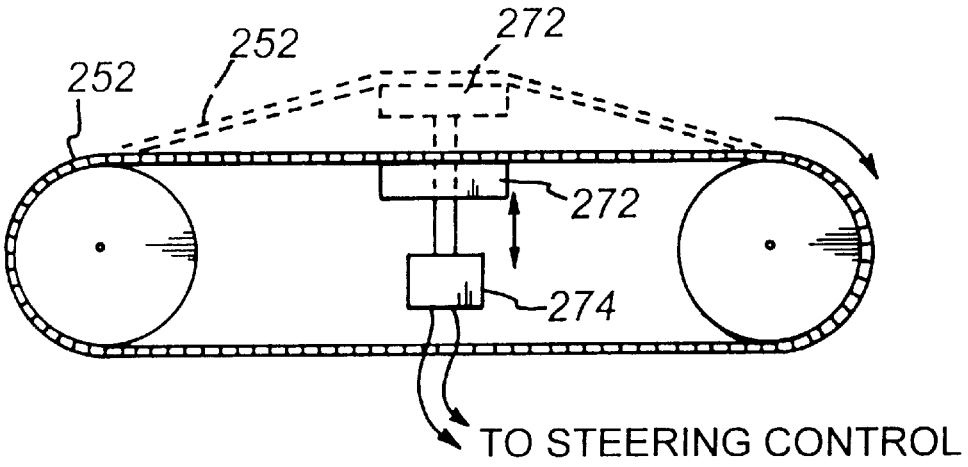
FIG. 11 is another alternative embodiment of a driving and guiding element according to this invention.

FIG. 11 illustrates an alternate steering mechanism according to this invention. An extendable is pressure plate 272 shown in both retracted and extended (phantom) positions causes the belt 252 to flex (phantom). The pressure plate is controlled by a linear motor 274 that can comprise a solenoid according to this embodiment and that is interconnected with steering controller (not shown). By stretching the belt 252, it is momentarily caused to move faster which forces the edge of the web (not shown) in contact with the belt 252 to surge forwardly further than the opposing belt (not shown) that has not stretched. In this manner, steering of the web can be effected by selective application of stretching force to each of the opposing belts.

Figure 12:
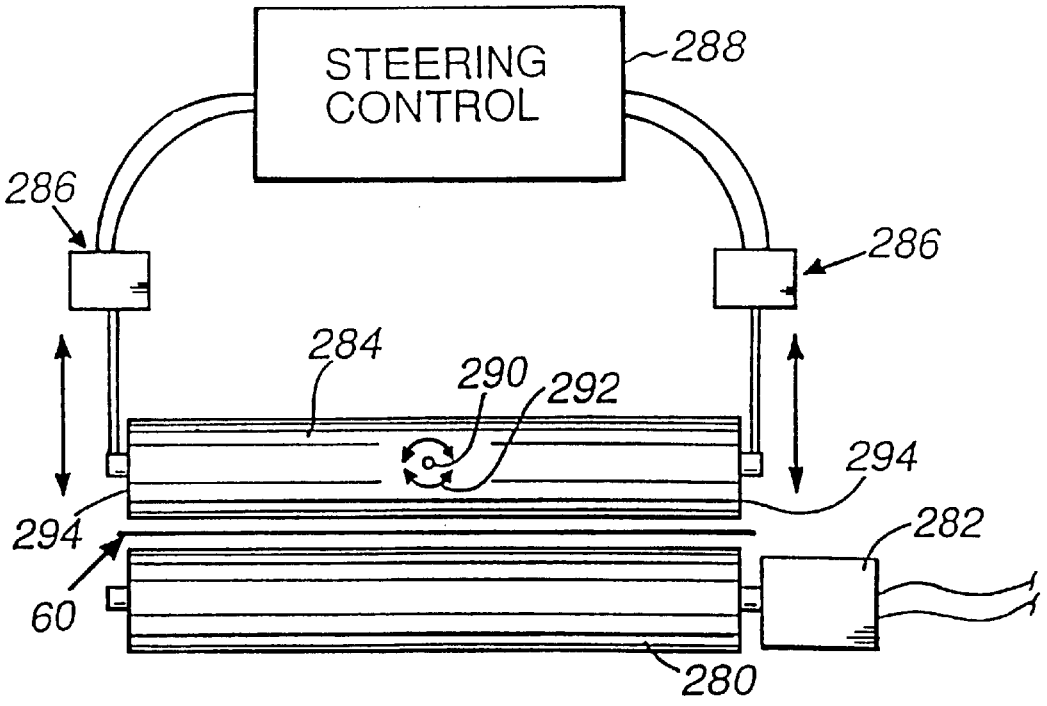
FIG. 12 is another alternate embodiment of a driving and guiding mechanism according to this invention.

FIG. 12 illustrates yet another embodiment for accomplishing the driving and guiding function according to this invention. It is contemplated that the web 60 can be driven by a full width drive roller 280 driven by a drive motor 282. Such a roller 280 can comprise an elastomeric material that changes diameter based upon application of force. A full width follower roller 284 can be located on opposing side of the web 60 from the drive roller 280. The follower roller can also comprise an elastomeric material or a harder substance such as polished metal. The drive roller 284 according to this embodiment is mounted on movable supports 286 that are interconnected with a steering controller 288. The supports 286 enable the follower roller 280 to pivot approximately about the axis 290 (curved arrow 292) so that opposing ends 294 of the roller 284 can be brought into more-forcible contact with the drive roller 280. Hence, the diameter of the drive roller 280 at a given end can be altered and the drag force generated between the drive roller 280 and follower roller 284 can be increased at a given end. The increase in drag and/or decrease in diameter cause the web to change direction as it passes through the drive and follower rollers 280 and 284, respectively. Thus, a full length roller can be utilized to positively steer the web 60 relative to the utilization device element.

In each of the foregoing embodiments, it is contemplated that the steering controller directs steering of the web 60 to align the web relative to the utilization device element. Such alignment ensures that the utilization device element performs its operation (such as printing) on the web at the desired location relative to the web's width-wise edges. As illustrated above, it should be clear that driving and guiding can be accomplished, according to this invention, at a single point along the web, along the entire width of the web, or at the edges of the web. The driving and guiding components described herein can be provided as an integral unit or can be divided into separate units that are located approximately adjacent, or remote from each other along the web's path of travel.

It is contemplated that the pinless web feed system according to this invention can be used selectively so that standard tractor pin feed web can still be utilized when desired. Hence, all components of the pinless feed system can be located out of interfering engagement with the tractor pin feed drive elements and all sensors used by the pinless feed system can be deactivated or switched back to a standard tractor pin feed drive mode. For example, a hole sensor can be retained and selectively connected to the utilization device's main controller to effect registration when desired. Additionally, as discussed above, the follower roller 76 can be moved out of interfering engagement with the upper side of the web 60 to enable the tractor pin feed drive elements 68 and 70 to effect drive of the web 60.

Figure 13:
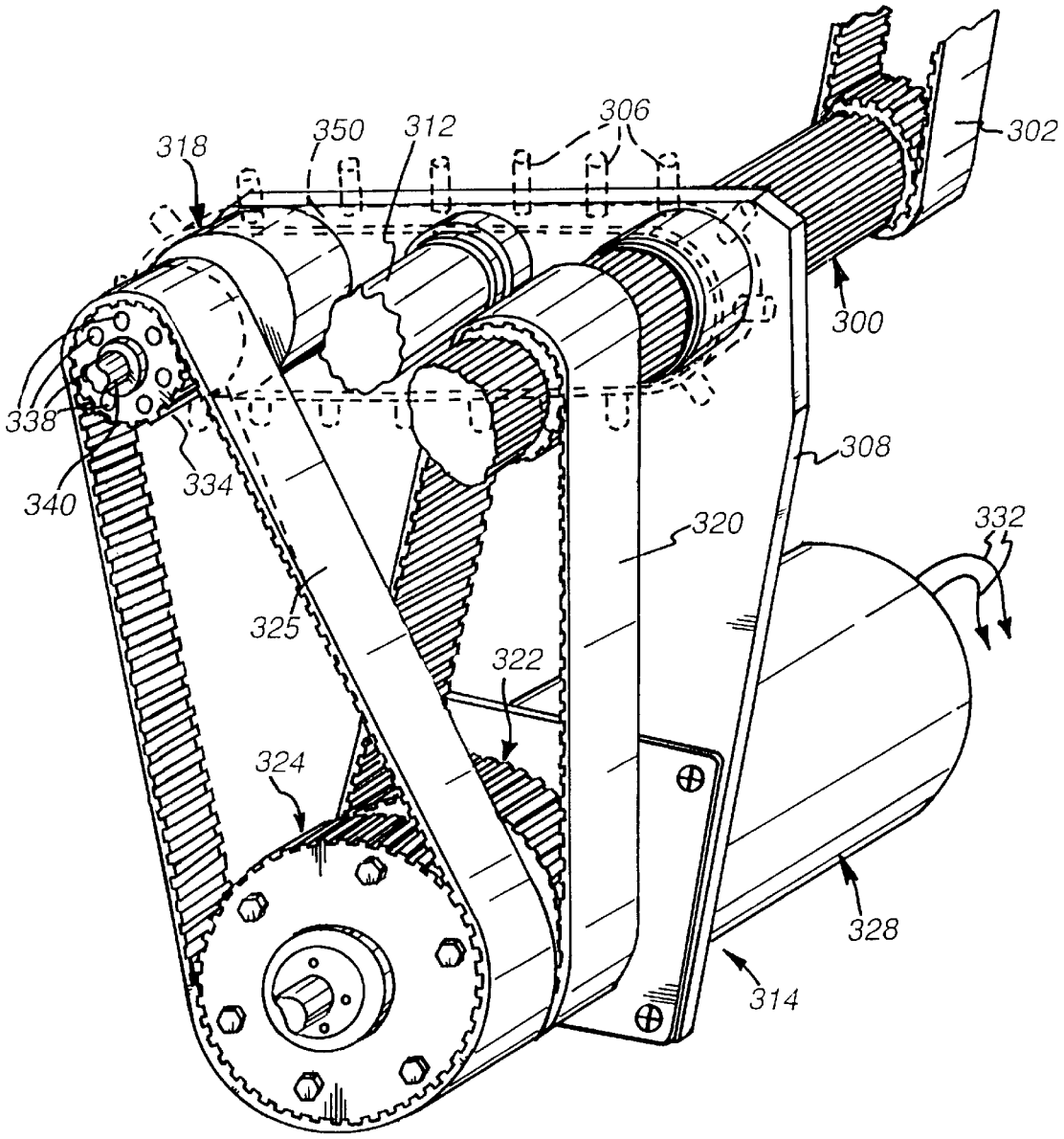
FIG. 13 is a partial perspective view of a registration drive system according to another embodiment of this invention.
Figure 14:
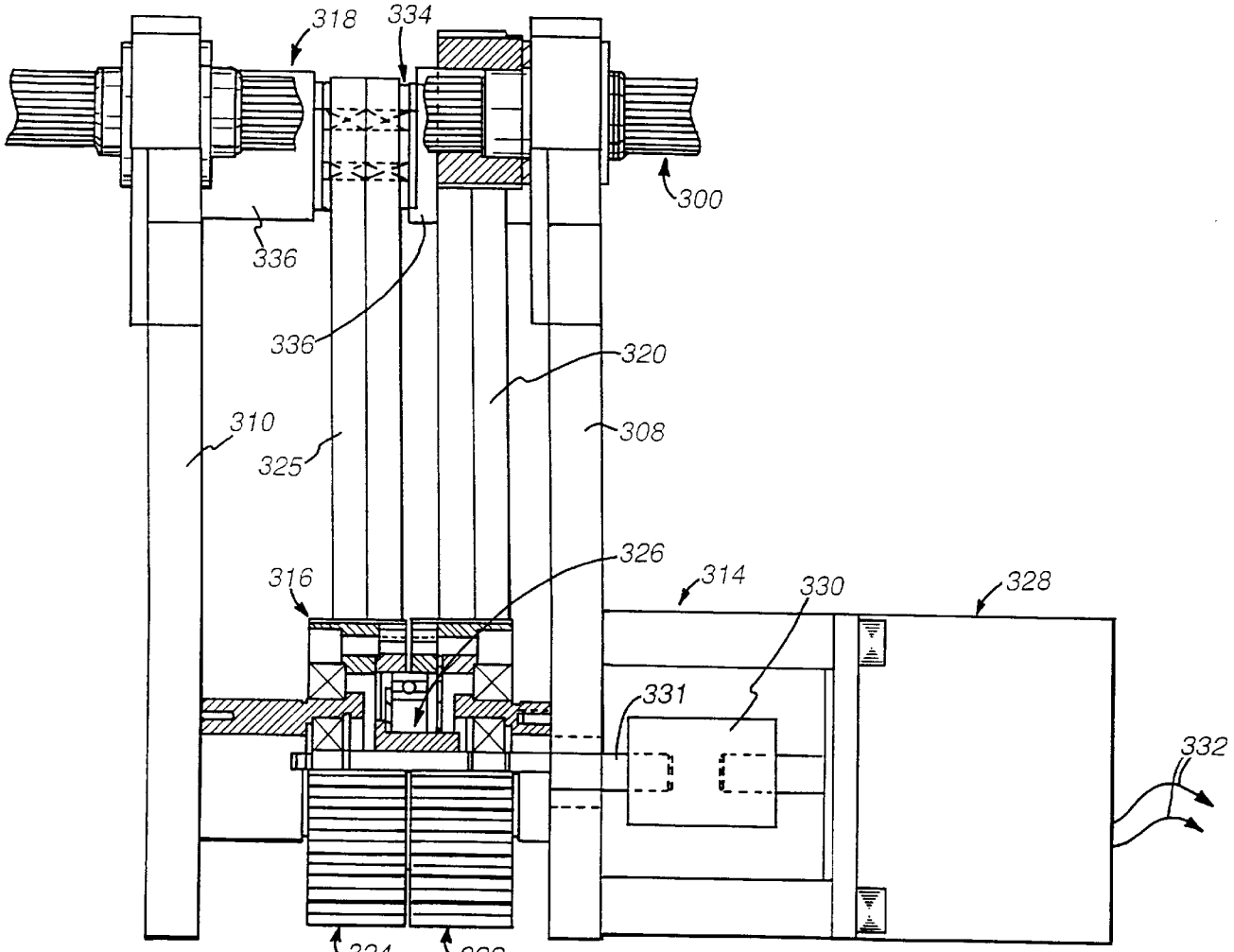
FIG. 14 is a partially exposed front view of the registration drive system of FIG. 13.
Figure 15:
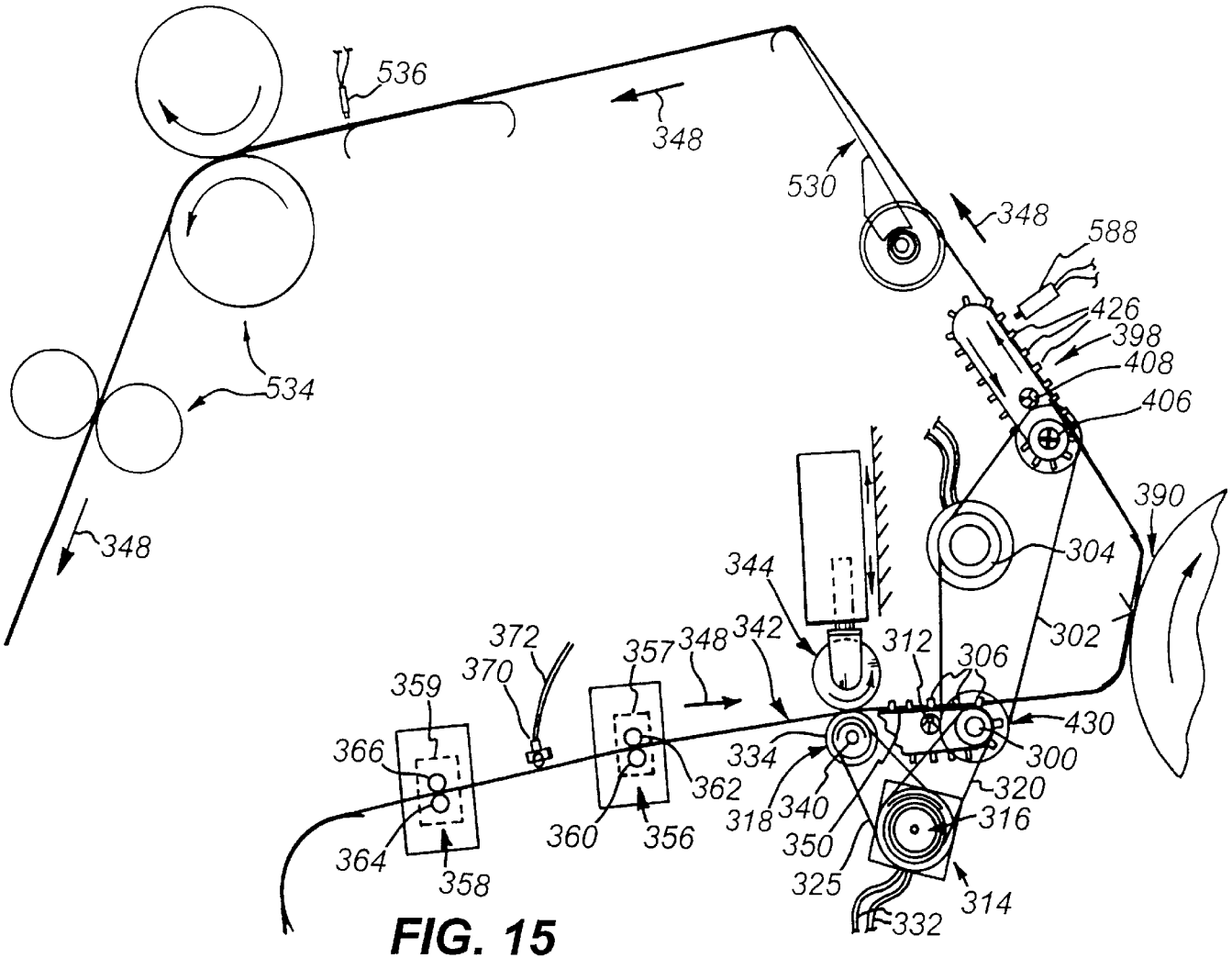
FIG. 15 is a somewhat schematic side view of the drive system according to the embodiment of FIG. 13 illustrating the web path of travel.

A registering drive assembly that is particularly suited to a pinless feed system installed in an IBM-type printer as described above, including the 3900™ series is detailed in FIGS. 13, 14 and 15. The existing pin feed drive spline shaft, the shaft 300 is connected by a timing belt 302 to a central drive motor 304 (FIG. 15). In this embodiment, the shaft 300 continues to drive tractor pins 306 in a normal manner. Support brackets 308 and 310 have been added and are supported by the splined shaft 300 and an existing guide shaft 312. The support brackets, in this embodiment can comprise plates formed from aluminum, steel or another metallic or synthetic material. At the lower end of the brackets 308 and 310 is positioned the registration drive system 314 according to this embodiment. As described above, the registration system according to an embodiment of this invention utilizes a harmonic drive differential assembly 316 that regulates the transfer of power from the shaft 300 to the web drive roller 318. A timing belt 320 extends from the shaft 300 to a driven timing gear 322 in the registration system 314. Another timing belt 325 extends from a driving timing gear in the registration system 314 to the drive roller 318. The harmonic drive differential assembly 326, shown generally in cross section in FIG. 14 interconnects the driven timing gear 322 and the driving timing gear 324. The driving timing gear 324 is driven at a slight differential (80:81 in this example) and, thus, the diameter of the drive roller 318 or the diameter of the central drive hub 334 (described below) is adjusted so that it provides a tangent of velocity that is approximately equivalent to the linear velocity of the tractor pins 306. A registration motor 328 which, in this embodiment can comprise a stepper motor or a servo, as connected by a coupling 330 to the input shaft 331 of the harmonic drive. By powering the motor in a forward or reverse direction, advance and retard motions can be provided to the drive wheel 318 relative to the drive shaft 300. The motor 328 is controlled through power inputs 332. They are interconnected with the central processor of this invention. The harmonic drive advances or retards one revolution for approximately 100 revolutions of the motor 328 according to this embodiment.

With reference to the drive roller, the belt 325 engages a central drive hub 334 with appropriate timing grooves. The ½ inch axial length central hub is provided with a smaller diameter than the adjacent drive surfaces 336. These drive surfaces can be serrated or bead blasted for providing further friction. The outer surface has a diameter of 1¼ inches in this embodiment. Overall axial length of the roller 318 is approximately 2 inches. The diameter of the hub is smaller and, typically, is chosen to provide appropriate tangent of velocity to the driving surfaces 336. A set of through holes 338 (FIG. 13) can be provided coaxially about the center of the roller. These holes 338 aid in lightning the roller for greater acceleration from a stop. The roller is supported on a shaft 340 between the support plates 308 and 310 at a position upstream of the drive shaft 300 and support bar 312. As detailed in FIG. 15, the roller 318 engages the web 342 under the pressure of an idler roller 344. The idler roller is spring loaded to provide a relatively constant pressure, thus forming a nip between the idler roller 344 and the drive roller 318. The idler roller can be constructed from an elastomeric material, a synthetic material such as Delrin® or, preferably, of a metal such as aluminum and can have a larger diameter than the drive roller 318. It typically contacts the driver roller along its entire axial length. In this embodiment, the registration and drive roller system are located between the two tractor pin feed units, adjacent the inboard most unit. In other words, adjacent the tractor pin feed unit on the left taken in a downstream direction (arrow 348 in FIG. 15).

As also noted above, the engaging surfaces 336 of the driver roller 318 can be located slightly above or below the plane of the tractor pin feed belts 350 to provide a desirable trough-shape to the input web 342 for enhanced guiding. In this embodiment, guiding of the web 342 into the drive roller 318 is facilitated by pairs of parallel stiffer bars 356 and 358 located upstream of the drive roller 318. The pairs 356 and 358 of bars each include individual parallel bars 360, 362 and 364, 366, respectively that are spaced from each other a few thousandths of an inch. The exact spacing should be sufficient to allow the largest thickness web to be contemplated to pass easily without excessive friction. The pairs 356 and 358 of bars are located approximately in line with the drive wheels so that they define between the upstream most pair of bars 358 and the drive roller 318 in approximately straight upwardly-sloping path in this embodiment. It has been determined that such a path is desirable in ensuring reliable feeding and formation of a guidable web. These bar pairs 356 and 358 can include movable stops 357 and 359 respectively (shown in phantom) for differing width webs. The bar pairs 356 and 358 are described further below. The bars 360, 362, 364 and 366 can be ¼ inch in diameter in one embodiment. They can be bowed to generate a desirable trough shape in the web.

Figure 21:
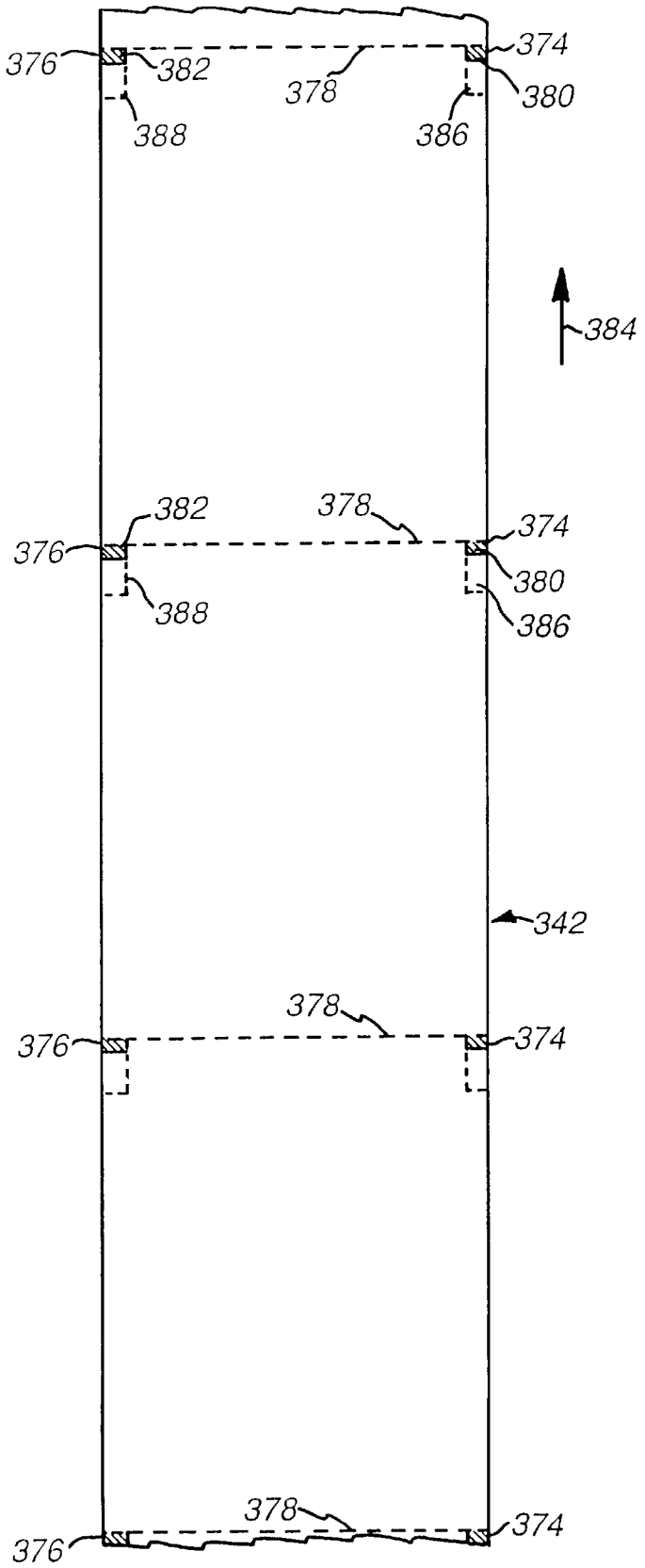
FIG. 21 is a plan view of a plurality of web sections illustrating timing mark locations and sizes according to this invention.

As described above, registration according to this invention is controlled by determining the relative progress of the web 342 through the printer. A fixed point which, in this embodiment, is between the two bar pairs 356 and 358 is chosen to scan for marks on the web. An optical sensor 370 interconnected by a cable 372 to the central processing unit (not shown) is utilized. The marks can comprise perforations, printing or any other readable formation on the web that occurs at known intervals. With reference to FIG. 21, a continuous web 342 is shown with marks 374 and 376 located on either side of the web. These marks can be applied prior to input of the web 342 into the printer. In this embodiment, they have provided adjacent the top of each page near a page break 378. Marks need not be provided adjacent each page break and can be provided at other locations along a given page or section of the web 342. Likewise, marks need only be applied to one side or the other of the web 342. Similarly, the mark can be applied remote from an edge of the web along some portion of the midsection of the web. In this embodiment, each mark 374 or 376 includes a darkened area 380 or 382. This darkened area, in a preferred embodiment has a width (taken in a direction transverse to a direction of web travel as shown by arrow 384 of approximately 0.1 inch and a length, (taken in a direction of web travel as shown by arrow 384) of approximately 0.060 inch. Upstream of each mark is a no-print zone 386 and 388 shown in phantom. The printer is, typically, instructed to locate no print at this area to ensure that the mark is properly read. In a preferred embodiment, marks 376 located along the left edge of the web are utilized. Location of the mark sensor 370 is described further below.

Figure 16:
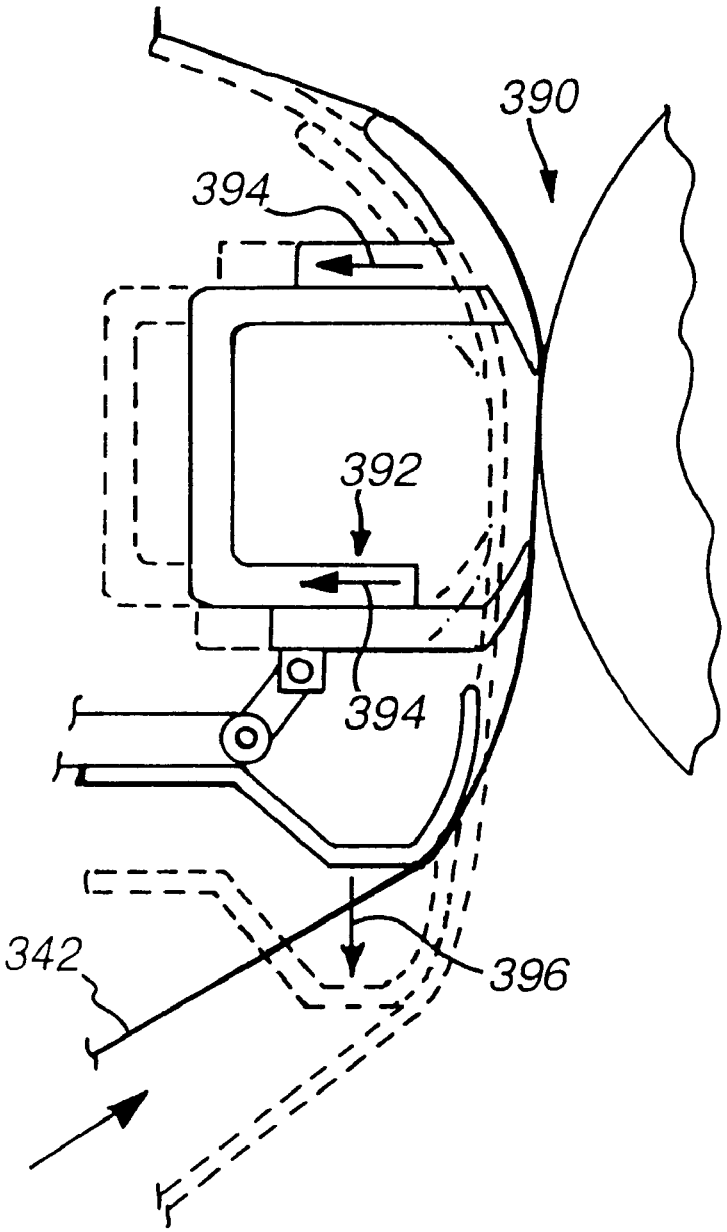
FIG. 16 (PRIOR ART)
FIG. 16 is a somewhat schematic side view of a web retraction system utilized in IBM-type printers according to the prior art.
Figure 17:
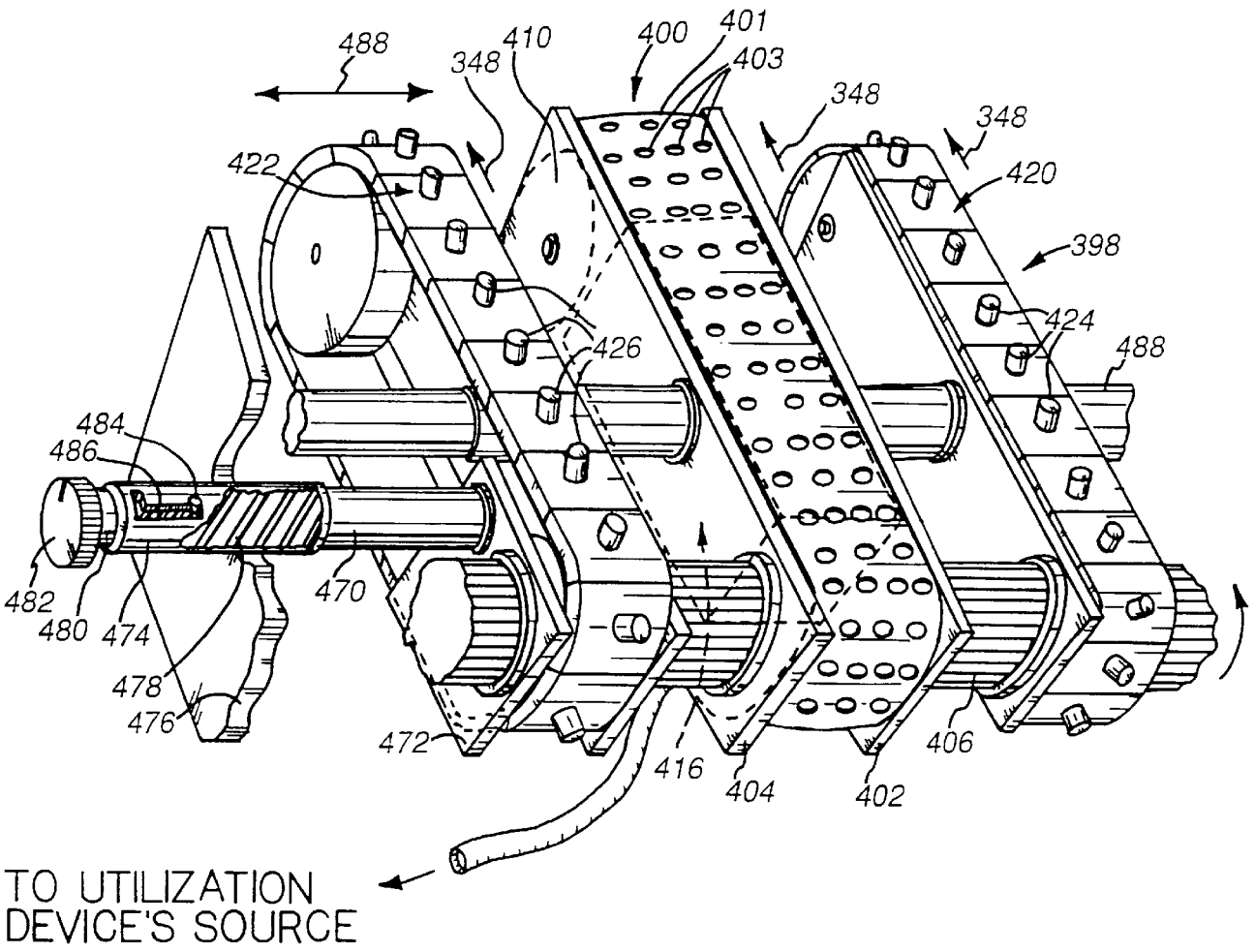
FIG. 17 is a partial perspective view of the upper tractor pin feed mechanism including a vacuum drive belt according to the embodiment of FIG. 13.
Figure 18:
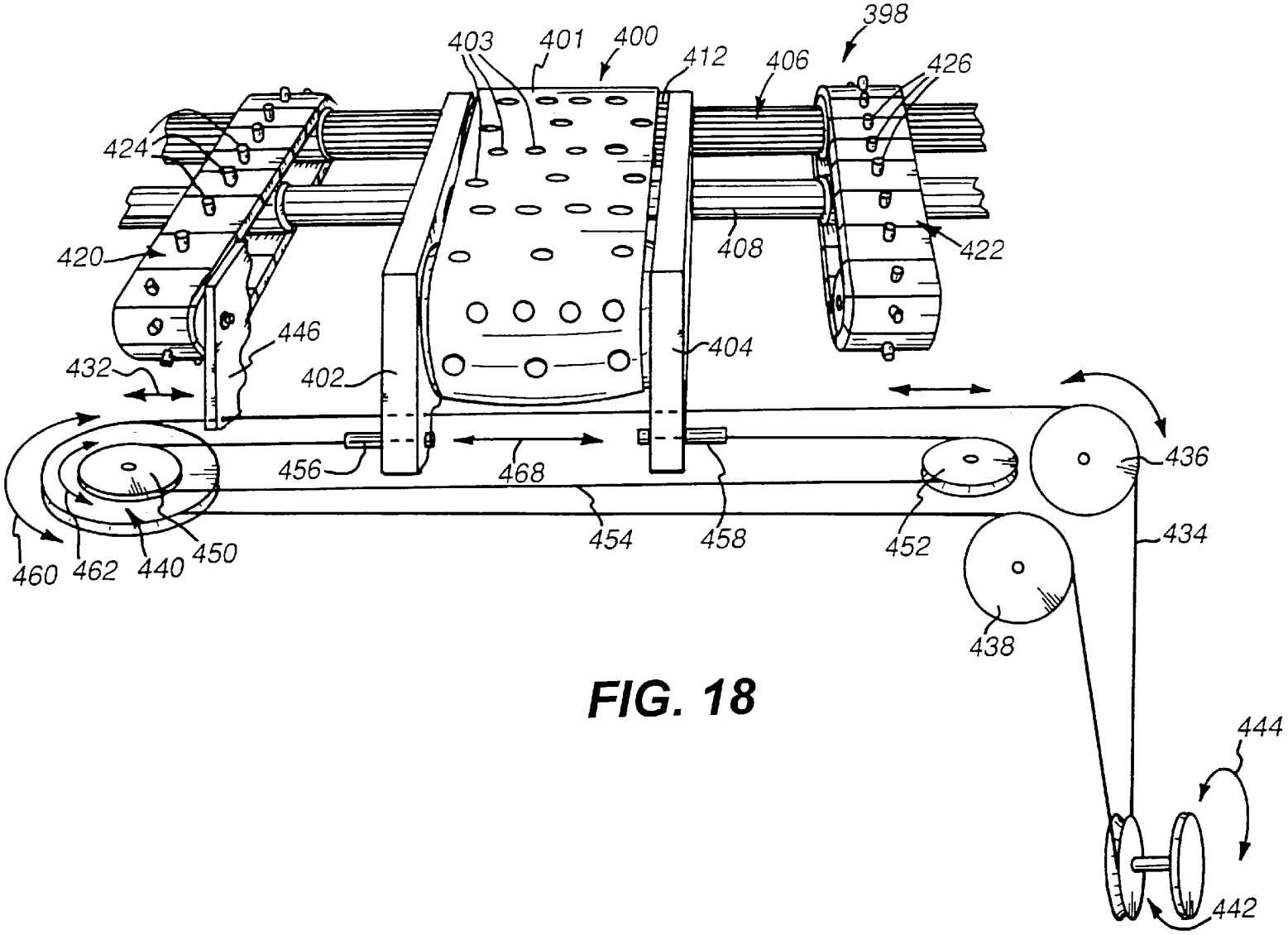
FIG. 18 is a partially exposed front perspective view of the upper tracker pin feed system of FIG. 17.

With further reference to FIG. 15, the web 342 is guided from the drive roller 318 to the image drum assembly 390. With reference to FIG. 16, the IBM series printer typically includes a web retractor mechanism 392 that is generally instructed, by the printer's internal control logic, to move away (arrows 394 from the image drum 390 to a retracted position) (shown in phantom). Simultaneously, a lower retractor moves downwardly, arrow 396 to remove slack in the web 342 as shown in phantom. According to the control logic of the IBM series printer, retraction movement occurs just prior to completion of a printing job. It has been recognized that without the stabilizing influence of the tractor pin feeds at the upper tractor pin feed assembly 398 (in FIG. 15), the retractors will cause the web to misalign roller to the image drum 390 prior to the completion of printing, causing a blurred image. FIG. 17 and 18 illustrate a vacuum belt assembly 400 for use in conjunction with the upper tractor feed assembly 398. The vacuum belt assembly 400 is mounted between a pair of support plates 402 and 404 that are rotatably fixed to the splined drive shaft 406 and the central support bar 408 of the existing tractor feed assembly 398. The vacuum belt in this embodiment comprises a perforated neoprene belt having a width of approximately 2½ inches and a series of perforations 403 of approximately ¼ inch. A slight radius or crown is provided to the front idler roller 410 (shown in phantom in FIG. 17) to maintain alignment of the belt. The driving roller 412 can be cylindrical in this embodiment and can include gnurling to ensure that a positive force is transferred to the belt 401.

Within the frame plates 402 and 404 is provided a seal vacuum box 416 (shown in phantom). The vacuum box is open at its top and in communication with the perforations 403. The surface of the belt 401 can be located so that it forms a slight trough or a slight arch in the web relative to the tractor pin feed belts 420 and 422. When the web 342 engages the vacuum belt, the frictional surface of the vacuum belt, in combination with the vacuum, directed through the perforations, causes the web to hold fast relative to the upper tractor feed assembly 398. Only movement of the tractor feed assembly via the drive shaft 406 is permitted. Accordingly, the vacuum belt assembly 400 takes the place of an interengagement between pins 424 and 426 and pin holes (not shown) on the web in the pinless feed embodiment according to this invention.

In order to accommodate differences of width web, the upper and lower tractor pin feed units 398 and 430, respectively, include at least one tractor pin feed belt assembly that is movable along their respective splined drive shaft and central supporting shaft. Movement of the upper tractor pin feed assembly 398 is described in FIG. 18, but a similar movement mechanism is utilized with reference to the lower tractor pin feed assembly. With reference to the downstream direction (arrow 348) the left, or closest tractor pin assembly belt 422 remains relatively fixed. The far tractor pin feed belt 420, however, is movable along the splined drive shaft 406 and supporting shaft 408 toward and away from the opposing tractor pin feed belt 422 as illustrated by the double arrow 432. This movement is controlled by a control cable 434 that is supported by pulleys 436, 438 and 440 is and moved by rotating a control wheel and pully assembly 442. Moving the control wheel and pulley assembly 442 in each of opposing directions (curved arrow 444) causes movement of the tractor pin feed belt 420 in each of opposing directions (arrows 432). The cable 434 is fixedly connected to a portion of the tractor pin feed belt frame 446 allowing linear motion of the cable 434 to be translated into movement of the tractor pin feed belt assembly 420. A second concentric pully 450 and a corresponding opposing idler pully 452 are provided with an inner cable 454 that is fixedly connected to the sides of the side plates 402 and 404 of the vacuum belt assembly 400. One or more turnbuckles 456 and 458 can be provided to maintain an appropriate tension in the inner cable 454. Movement of the main control cable 434 causes the pully 440 to rotate (double curved arrow 460) which, in turn, rotates (double curved arrow 462) the inner concentric pully 450, assuming that the inner cable 454 is sufficiently taut and that an appropriate friction between the cable 454 and the pully 450 is maintained, the cable will move, causing the vacuum belt assembly 400 to move (double arrow 468) in conjunction with the tractor pin feed belt assembly 420. The diameter of the inner concentric pully 450 is half the diameter of the outer main pully 440. Accordingly, the movement of the inner cable 454 will be exactly half that of the corresponding movement of the outer cable 434. Thus, the vacuum belt assembly moves only one half the distance moved by the tractor pin feed assembly 420. In this manner, the vacuum belt assembly 400 maintains an alignment that is approximately centered relative to each of the opposing tractor pin feed belt assemblies 420 and 422 at all times. Such a drive mechanism adjustment system can be provided to the lower drive wheel 318 and its associated registration system.

Both the upper tractor pin feed assembly 398 and the lower tractor pin feed assembly 430 include fixed tractor pin feed belts that are typically not movable in the original printer. In order to insure that printing on the image drum is properly centered, it is desirable to move the fixed tractor pin feed belt inwardly toward the opposing tractor pin feed belt. The absence of tractor pin feed strips which, typically, are one half inch in width would, otherwise, cause a pinless web to be misaligned by approximately half that distance, or, one eighth inch. This is because the unperforated edge, when resting against the pins is moved inwardly one eighth inch more than it would normally be positioned if a web containing pinholes were engaged by the pins. Accordingly, both the upper and lower fixed tractor pin feed belts have been made movable over a small distance. Referring to FIG. 17, a shaft 470 has been attached to the side plate 472 of the tractor pin feed belt 422. Any stops that would prevent the tractor pin feed belt from moving relative to, for example, the central rod 408, have been removed. Thus, tractor pin feed belt assembly 422 would be free to move on the drive shaft 406 and central shaft 408 but for the intervention of the rod 470. The rod 470 engages a collar or housing 474 that is fixed to the frame of the printer 476. A spring 478 can be used to bias the rod 470 relative to the housing 474. By rotating a shaft 480 having a control knob 482 and a stop 484, that rides in a two position slot 486, the operator can select between two positions (double arrow 488) that represent a pinless feed and a pin feed position. The pin feed position is the normal fixed position for the tractor pin feed belt 422, while the pinless feed position is a location inwardly toward the opposing tractor pin feed belt 420, approximately 1/10–1/8 inch. The adjustment knob 42 allows for quick change between pinless and pin feed operation. As noted below, a similar adjustment knob can be provided to the lower pin feed assembly 430.

Figure 19:
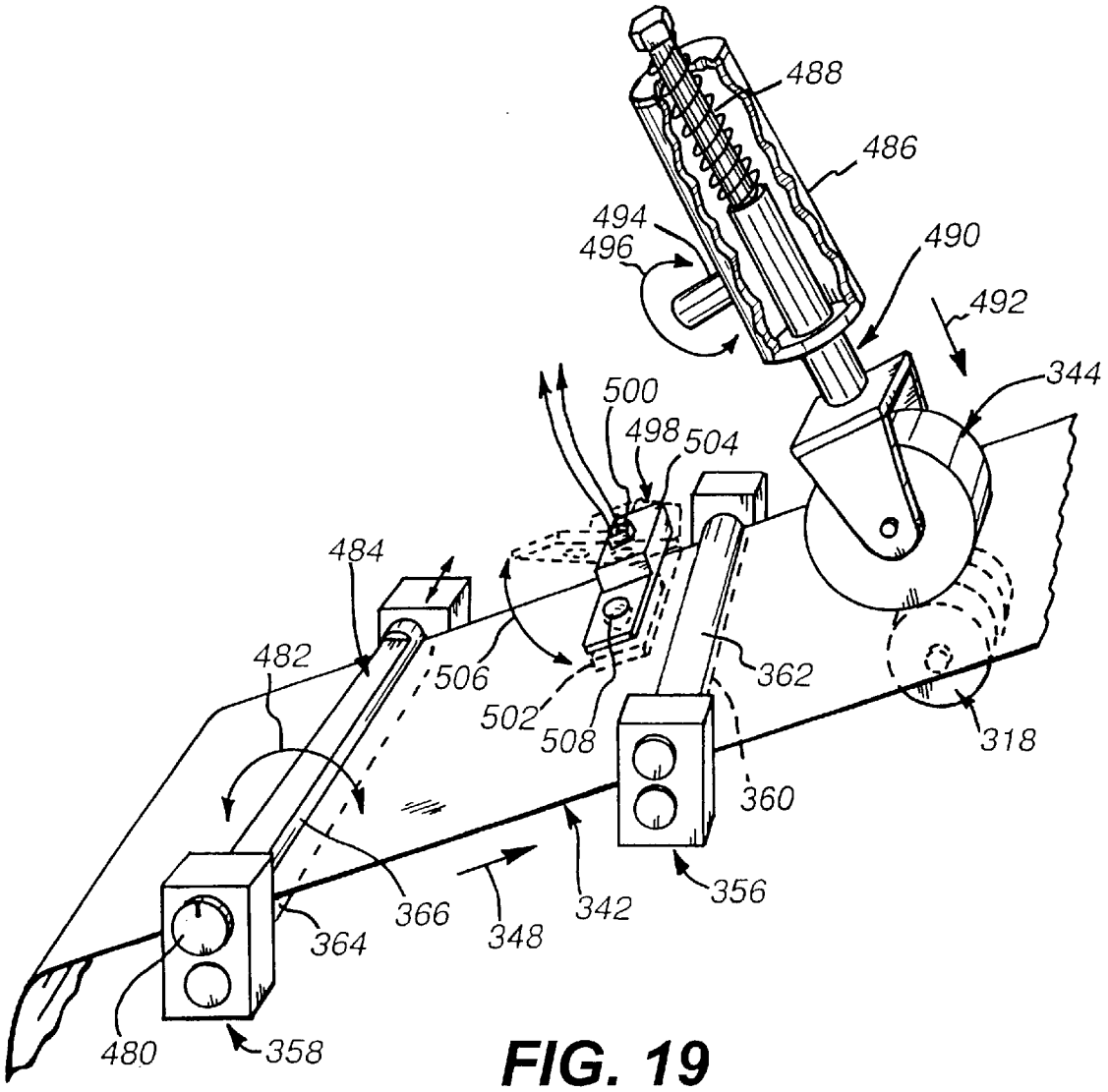
FIG. 19 is a partial perspective view of the web path adjacent the drive roller, detailing a mark sensor according to one embodiment.
Figure 20:
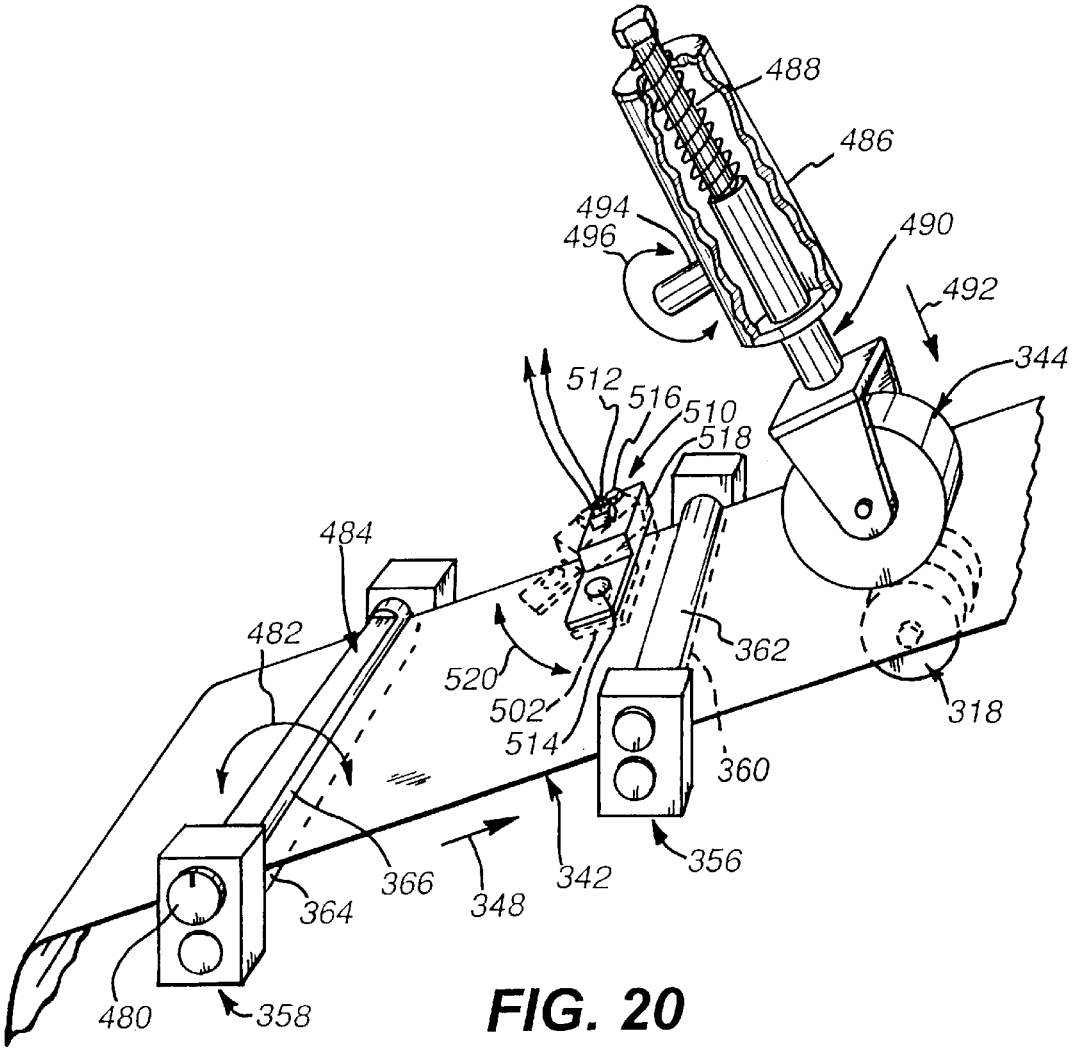
FIG. 20 is a partial perspective view of the web path adjacent the drive roller, detailing a mark sensor according to another embodiment.

Reference is made to FIGS. 19 and 20 which show, in more detail, the alignment of the stiffener bar pairs 356 and 358 in the engagement of the idler roller 344 with the drive roller 318. In this embodiment, the upper stiffener bar 366 of the upstream stiffener bar pair 358 includes a control knob 480 that enables the bar 366 to rotate (curve arrow 482) to selectively present a flat surface 484 adjacent the web 342. The flat surface 484 is located opposite the web 342 during loading to provide a larger gap for easier threading of the web through the stiffener bar pair 358.

The idler roller in this embodiment is provided within a housing 486 in which a spring 488 biases the idler roller bracket assembly 490 against the drive roller 318 (arrow 492). The pressure of the spring is set at a few pounds, but it can be varied within a relatively wide range depending upon the type of surfaces used for the idler roller 344 and drive roller 318. For a hard steel or aluminum drive and idler roller, a few pounds of pressure should be sufficient to form an appropriate driving nip. The exact amount of pressure can be determined on a trail and error basis.

The housing 486 can be provided with a pivot 494 that enables a small range of rotation (curved arrow 496) about an axis aligned with the direction of web travel (arrow 348). Pivotally mounting the idler roller insures that it presents a flat, fully contacting surface against the drive roller 318.

FIG. 19 illustrates one embodiment of a mark sensor 498 according to this invention. The mark sensor overlies the web 342 in a position that enables an optical sensing element 500 to scan for pre-printed marks. As noted above, these marks enable control of registration. A platen 502 (shown in phantom) is provided beneath the web 342 so that the web is supported adjacent the mark sensor. The upper portion 504 of the mark sensor 498 can be hinged (curved arrow 506) away from the web (as shown in phantom) for ease of loading the web. The upper portion 504 can include a roller ball bearing or similar weighted roller 508 that maintains the web securely against the platen, thus insuring that an accurate reading of marks is obtained. In an alternate embodiment of a mark sensor 510, illustrated in FIG. 20, the optical sensor 512 also scans for marks and a roller bearing 514 is utilized. In this embodiment, a pivot point 516 is provided so that the upper portion 518 of the sensor 510 can rotate (curved arrow 520) within the plane of the web 342, out of contact with the web. Partial displacement of the sensor upper portion 518 is shown in phantom.

Figure 22:
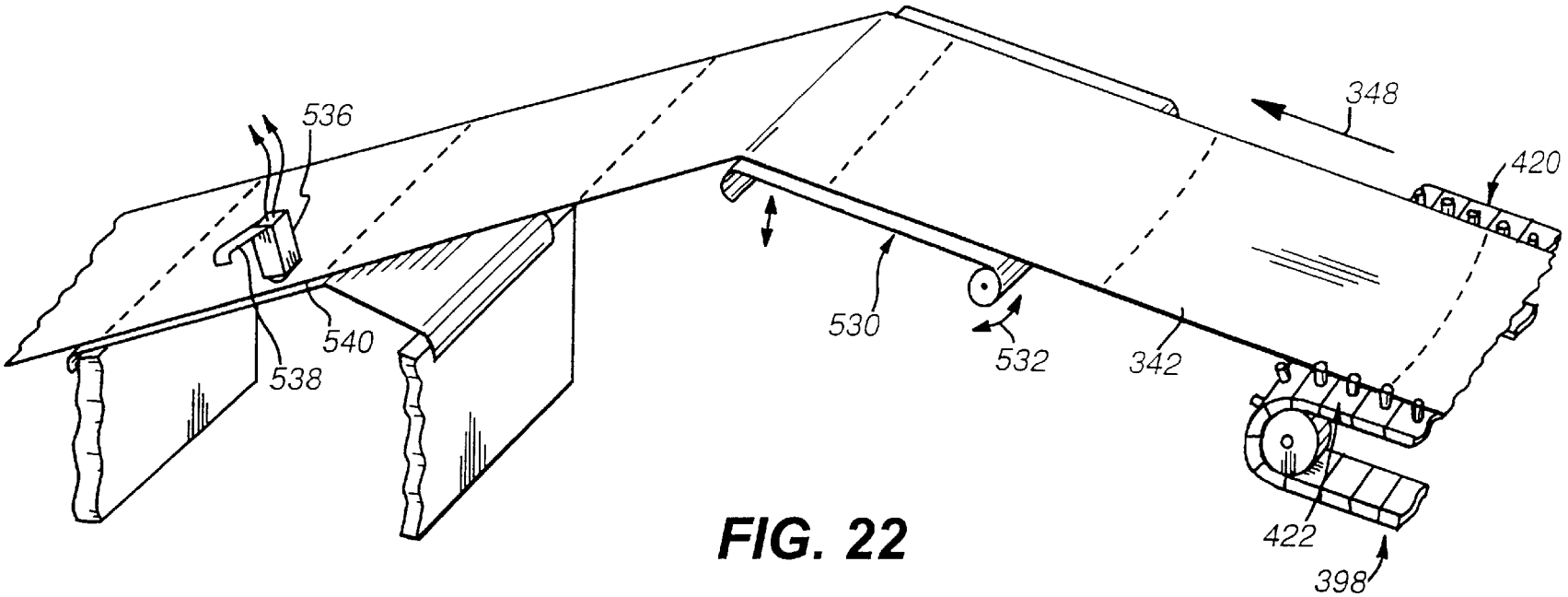
FIG. 22 is a partial schematic view of the web path including a skew sensor location according to embodiment of FIG. 13.

In modifing the IBM series printer, it is recognized that pinless web may affect other aspects of the feeding process. As further detailed in FIG. 22, the web 342 exits the upper tractor feed unit 398 and passes over a dancer 530 that pivots (curved arrow 532) in response to tension exerted on the web between the fuser section 534 (FIG. 15) and the upper tractor feed unit 398. The dancer 530 instructs the fuser section 534 to speed and slow so that a relatively constant-sized loop of web 342 is maintained. Slightly upstream of the fuser section 534 is located a skew sensor 536. In the unmodified printer, a skew sensor uses an optical signal to read the amount of reflected light returned from the pin feed holes as they pass under the sensor. However, since no pin feed holes are present, the skew sensor 536 according to this invention is moved inboard on a bracket 538 so that it is positioned adjacent an edge 540 of the web 342. The skew sensor 536 is interconnected with the printer control logic and operates in a manner similarly to the original sensor. It consists of at least two receptors that signal the presence or absence of a balance of transmission between signals.

Figure 23:
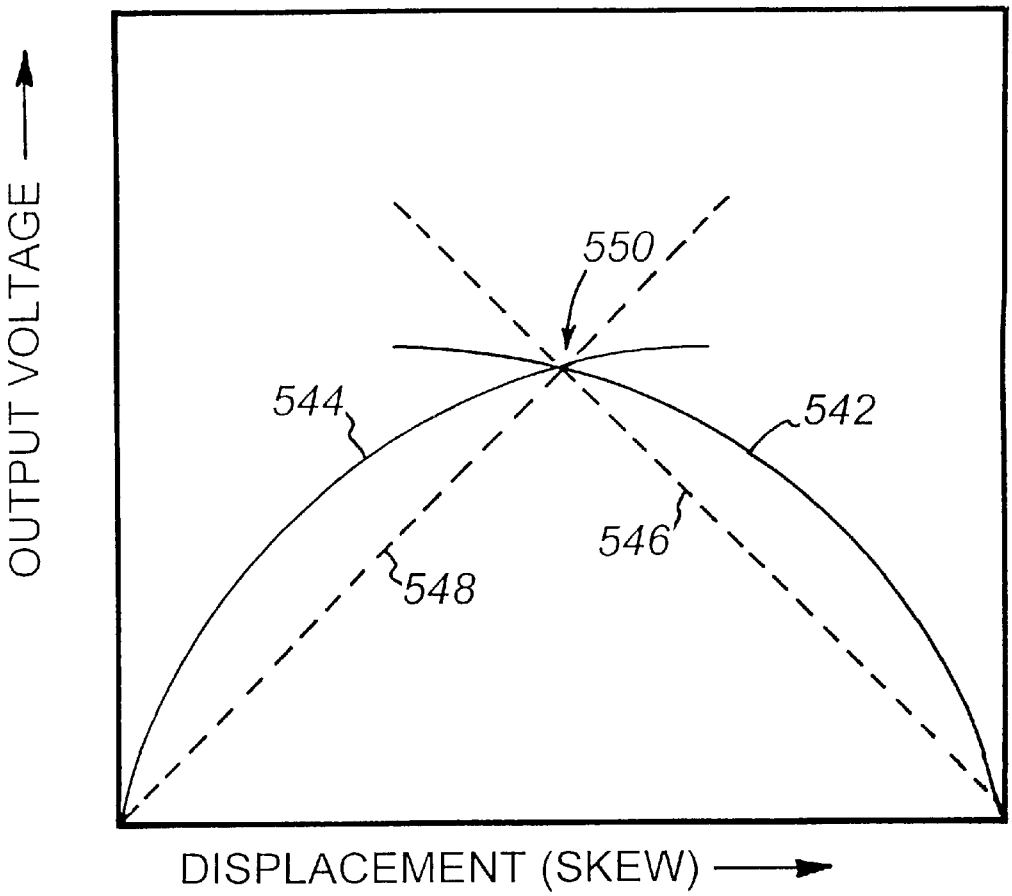
FIG. 23 is a graph of voltage versus skew for the skew sensor of FIG. 22.

When the signals are balanced, it indicates that the edge 540 is located directly between the two sensors. With reference to FIG. 23, the performance of the sensors is illustrated by a pair of curves 542 and 544 that show output voltage of the sensor versus displacement or "skew". It has been recognized that the output voltage versus skew is modeled approximately on a section of a circle. The original sensor included logic modeled on straight lines 546 and 548 shown in phantom. Accordingly, the skew sensor of this invention more accurately reads drift of an edge 540. Drift or skew of the edge 540 is compensated for by steering the rollers of the fusion section 534. In other words, these rollers are angled to cause a sideways drift of the web similar to that shown in FIG. 12. Steering is performed until both output signals cross at an approximate center point 550 wherein the edge 540 is balanced between the two sections of the sensor.

Figure 24:
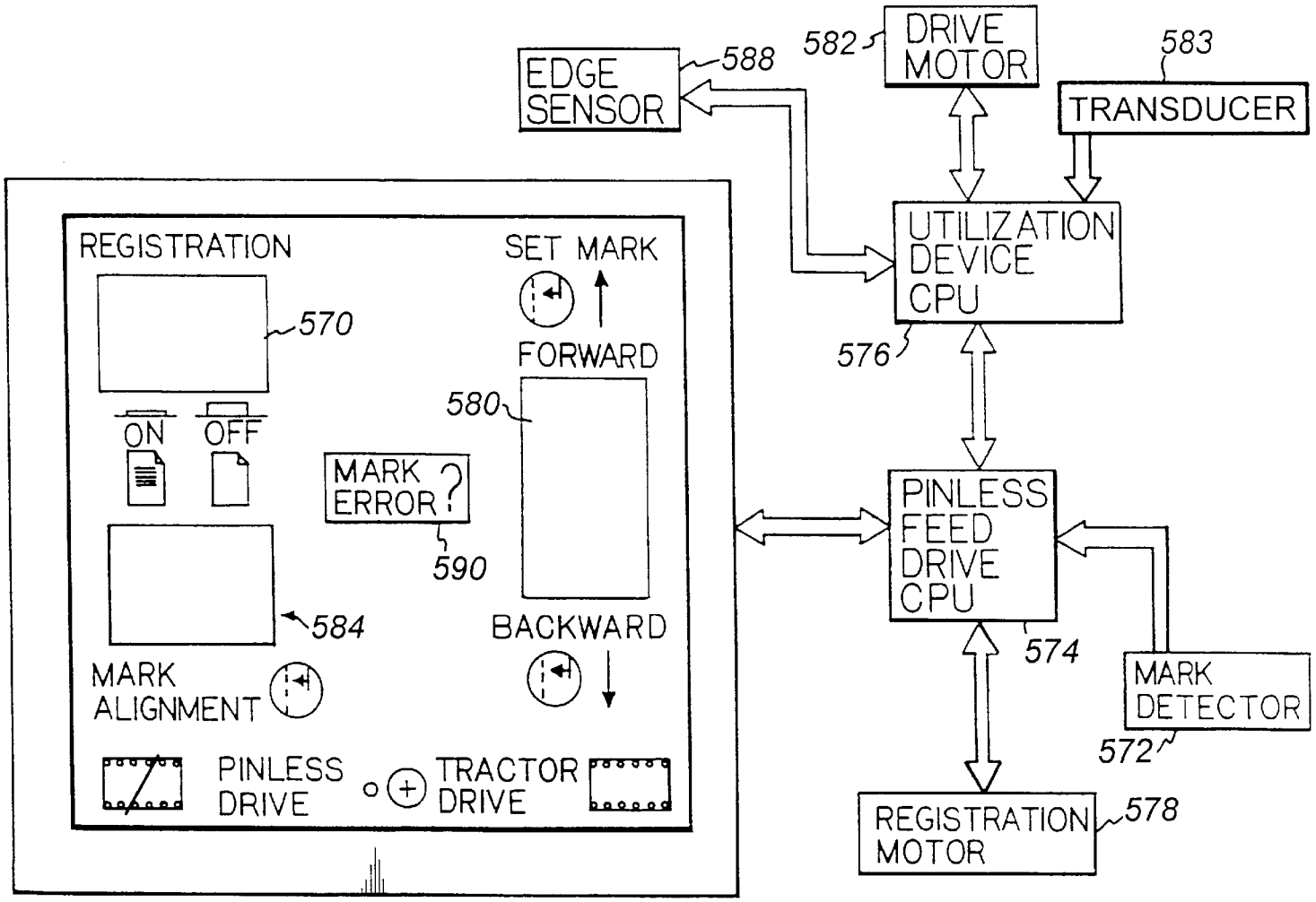
FIG. 24 is a control panel for use in the embodiment of FIG. 13.

With further reference to FIG. 24, a discussion of control of the pinless drive system according to this embodiment is now provided. In normal operation, the mark sensor according to this invention scans for marks when the registration control button 570 is activated. The mark detector 572 signals the pinless feed drive central processing unit 574 as each mark on the web passes under it. Simultaneously, the utilization device CPU 576 is tapped to read tractor pulse movement information. A transducer drain at block 583 (not shown) located in the tractor pin feed system transmits a pulse each 0.008 inch of linear web movement. A comparison is made between passing of web through the tractor pin feed system, counting pulses and the known distance between marks. Any difference in the comparison causes the pinless feed drive CPU 574 to transmit an advance or retard signal to the registration motor 578.

The IBM series printer includes a function known as "autoload". In autoload, sheets are automatically driven through the tractor pin feed units and properly registered. To perform an autoload function, the sheet is threaded through the stiffener bars and into the lower tractor pin feed unit and drive wheel. The movement override switch 580 is instructed to move the web forward by directing a command through to the utilization device CPU and from the utilization device CPU to the drive motor 582. The pinless feed drive CPU taps the utilization device CPU for information about pulses as the sheet is moved forward. Movement occurs until mark alignment is indicated by the mark alignment indicator 584. At this time, a mark has been aligned directly under the mark detector 572. The number of pulses counted during that period is stored by the pinless feed drive CPU. To further determine the "top of form" so that printing is aligned with the front edge of the web, the web continues upwardly into the upper tractor pin feed unit to an upper edge sensor 588 (see also FIG. 15). This upper edge sensor also operates to detect jams during normal running operation. The edge sensor indicates when the "top of form" has been reached. The number of pulses to reach this top of form location are also recorded. Typically, another mark is read and then the system automatically retards the number of pulses required to place the top of form adjacent the image drum at initial point for printing. Following the alignment of top of form, the web begins advancing and printing begins as the web passes over the dancer and into the fuser section under its own guidance.

An added feature of the pinless feed drive CPU according to this invention is that it deactivates the vacuum on the vacuum belt assembly 400 of the upper tractor feed drive unit 398. This enables any slack in the web to be drawn up by the fuser section without the risk of crumbling between the upper tractor feed drive 398 and image drum 390.

It should be noted that a variety of registration protocols can be employed according to this invention. One particular protocol involves the establishment of a drive rate constant at initialization of a print run by determining the exact spacing between marks and comparing the spacing to the known distance generated by the pulses of the tractor feed unit. This constant can be used for subsequent calibration of the registration system as printing proceeds. The process of monitoring web travel and comparing actual travel to read travel can be implemented using a discrete comparator circuit or with a microprocessor that employs an appropriate software routine.

The pinless feed system according to this invention can include appropriate error warnings such as the mark reading error indicator 590, shown in FIG. 24. Further jam and feeding detectors can also be provided. These can signal alarms or shut down the print process and can record a number of erroneous sections of web by using appropriate counters interconnected with the mark sensor and/or utilization device CPU.

The foregoing has been a detailed description of preferred embodiments. Various modifications and additions can be made without departing from the spirit and scope of this invention. For example, while a roller drive is used according to this invention, belts or vacuum drive units, among others, can be substituted. A harmonic drive is used as a registration differential. However, a variety of other forms of differential and advance/retard mechanisms are also contemplated.

Accordingly, this description is meant to be taken only by way of example and not to otherwise limit the scope of the invention.

What is claimed is:

1. A utilization device adapted to feed either of a pin feed continuous web having tractor pin feed holes and a pinless continuous web devoid of pin holes and having marks disposed in an upstream-to-downstream direction therealong at predetermined length intervals, the utilization device comprising:

a moving tractor pin feed system including a lower tractor feed unit, wherein the lower tractor feed unit includes opposing moving tractor pin feed strips each having sets of pins located outwardly of opposing side edges of the pinless continuous web;

a high volume moving utilization device element, located downstream of the lower tractor feed unit that rotates at an element movement speed and thereby performs a predetermined operation at selected locations onto either of the pin feed continuous web and the pinless continuous web;

a drive roller that engages the pinless continuous web at a location upstream of the image transfer drum and that drives the pinless continuous web toward the image transfer drum;

a central drive motor that drives the lower tractor pin feed unit at a speed that matches the drum speed of the utilization device element;

a differential having a central drive motor input and a differential input, the differential being operatively interconnected with the drive roller and the differential being constructed and arranged so that the drive roller rotates in conjunction with the central drive motor at a roller rotational speed, wherein the roller rotational speed is varied based upon input movement at the differential input;

a mark sensor located at a predetermined distance from the image transfer drum that reads occurrences of the marks on the pinless continuous web as the pinless continuous web passes therethrough and generates a mark sensor signal in response to a sensed occurrence of each of the marks;

a transducer that generates length increment signals in response to predetermined movment of the tractor pin feed system;

a registration controller that receives the mark signal and the movement signal, the registration controller being constructed and arranged to compare the mark sensor signal to the movement signal and thereby generate a control signal; and a registration controller motor interconnected with and controlled by the registration controller, the registration controller motor being operatively interconnected to the differential input to drive the differential to thereby vary the roller rotational speed of the drive roller in response to the control signal.

2. The utilization device as set forth in claim 1 wherein the differential comprises a harmonic drive.

3. The utilization device set forth in claim 1 further comprising two pairs of parallel bars located upstream of the lower tractor pin feed unit that receive web therebetween, the web defining an approximately straight line path between each of the pairs of parallel bars and the lower tractor pin feed unit.

4. The utilization device as set forth in claim 3 wherein at least one of the pairs of bars includes end stops that engage side edges of the web.

5. The utilization device as set forth in claim 4 wherein at least one of the end stops is movable along the bars to change a width defined between each of the end stops.

6. The utilization device as set forth in claim 1 wherein the controller further includes a comparing circuit that compares the mark signal to the drive movement signal and that rotates the differential motor at selected times in a selected direction of rotation to vary the drive rate of the web so as to synchronize movement of the web with a movement of the utilization device element.

7. The utilization device as set forth in claim 6 further comprising a top-of-form controller that determines a location of an initial portion of a web fed to the utilization device element and that signals when the initial portion of the web is located at a desired location relative to the utilization element.

8. The utilization device as set forth in claim 1 wherein the tractor pin feed system further includes an upper tractor pin feed unit including opposing moving tractor pin feed strips each having sets of pins located out-wardly of opposing side edges of the pinless continuous web.

9. The utilization device as set forth in claim 1 further comprising a dancer assembly having a pivotally mounted dancer bar that moves in response to web tension, located downstream in a direction of web travel of the upper tractor pin feed unit, the dancer assembly engaging the web and including a dancer bar movement sensor that thereby controls a draw of the web from the upper tractor pin feed unit by regulating a drive speed of the drive assembly.

10. The utilization device as set forth in claim 1 wherein the mark sensor includes a mounting base having a freely rotating mass that applies pressure to a portion of the web passing there through to maintain a portion of the web against a portion of the base.

11. The utilization device as set forth in claim 1 wherein the opposing side edges of the pinless continuous web define therebetween a plane and wherein a surface of the drive roller at a location in engagement with the pinless continuous web is located remote from the plane whereby the drive roller causes the pinless continuous web to assume a trough shape for added stiffness thereof.

12. The printing device as set forth in claim 11 further comprising movable covers constructed and arranged to respectively overlie each of the pin feed strips at selected times that respectively maintain the opposing side edges of the pinless continuous web in engagement with the pin feed strips.

13. The printing device as set forth in claim 1 wherein the drive roller is positioned on a shaft between each of the opposing tractor pin feed strips and wherein the drive roller has a width, in a direction transverse to the upstream-to downstream direction less than a spacing between the tractor pin feed strips so that opposing widthwise edges of the drive roller are remote from the tractor pin feed strips.

14. The utilization device as set forth in claim 1 wherein the mark sensor senses marks and generates pulses within a predetermined time period if a mark is sensed.

15. The utilization device as set forth in claim 14 wherein the transducer generates each pulse in response to movement of the tractor pin feed system to drive the pin feed continuous web a linear distance increment of 0.008 inch.

16. A method for adapting a printing device that feeds a continuous pin feed web in a downstream direction by engaging pin feed perforations on side edges thereof to feed a continuous pinless web having side edges that are free of pin feed perforations, the printing device having a moving tractor pin feed system including a lower tractor pin feed unit, and a high volume rotating image drum located on a web feed path therebetween, and the tractor pin feed system being operatively connected to and moving at a speed that is synchronized with a rotational speed of the rotating image drum, the tractor pin feed system generating a drive movement pulse signal based upon movement of predetermined web length increments therethrough, the method comprising:

operatively connecting a drive roller, having a confronting idler, to a drive axle of the lower tractor pin feed unit including providing a differential between the drive axle and the drive roller and interconnecting a differential motor to the differential for advancing and retarding a rotation of the drive roller relative to the drive axle, including positioning the drive roller in an alignment that is between opposing tractor pin feed strips of the lower tractor pin feed unit and arranging the opposing tractor pin feed strips out-wardly of respective side edges of the pinless web;

locating a mark sensor that reads marks located at predetermined intervals on the pinless web and that generates a mark sensor signal in response to reading the marks at a location at a predetermined distance from the image element; and providing a registration controller that compares the mark sensor signal and the drive movement pulse signal to selectively operate the differential motor to advance and retard the drive roller relative to the lower axle.

17. The method as set forth in claim 16 further comprising positioning a pair of parallel web guide bars defining a guide slot therebetween upstream of the drive roller along the feed path.

18. The method as set forth in claim 17 wherein the step of locating the mark sensor includes positioning the mark sensor on the guide bars.

19. The method as set forth in claim 17 further comprising positioning another pair of parallel web guide bars defining a guide slot therebetween upstream of the drive roller.

20. The method as set forth in claim 16 wherein the step of providing the differential includes locating the differential remote from the drive axle of the lower tractor pin feed unit and remote from the drive roller and forming a first mechanical interconnection between the drive axle of the lower tractor pin feed unit and the differential and forming a second mechanical interconnection between the differential and the drive roller, respectively.

21. The method as set forth in claim 20 wherein the step of forming the first mechanical interconnection includes attaching a first drive belt between the drive axle of the lower tractor pin feed unit and the differential and the second step of forming the second mechanical interconnection includes attaching a second drive belt between the differential and the drive roller.

22. A controller for use in a utilization device adapted to feed either of a pin feed continuous web having tractor pin feed holes and a pinless continuous web devoid of pin holes and having marks disposed in an upstream-to-downstream direction therealong at predetermined length intervals having a tractor pin feed system that includes a lower tractor feed unit, wherein the lower tractor feed unit includes opposing moving tractor pin feed strips each having sets of pins located outwardly of opposing side edges of the pinless continuous web, a high volume moving utilization device element, located downstream of the lower tractor feed unit that rotates at an element movement speed and that thereby performs a predetermined operation at selected locations onto either of the pin feed continuous web and the pinless continuous web a drive roller that engages the pinless continuous web at a location upstream of the utilization device element and drives the pinless continuous web toward the utilization device element, a central drive motor that drives the lower tractor pin feed unit at a speed that matches the speed of the utilization device element, a differential having a central drive motor input and a differential input, the differential being operatively interconnected with the drive roller and the differential being constructed and arranged so that the drive roller rotates in conjunction with the central drive motor at a roller rotational speed, wherein the roller rotational speed is varied based upon input movement at the differential input a mark sensor, located at a predetermined distance from the utilization device element that reads occurrences of the marks on the pinless continuous web as the pinless continuous web passes therethrough and that generates a mark sensor signal in response to a sensed occurrence of each of the marks, a transducer, connected to the tractor pin feed system, constructed and arranged to provide a pulse that indicates an amount of movement of the pin feed continuous web through the tractor pin feed system, and a registration controller motor being operatively interconnected to the differential input to drive the differential to thereby vary the roller rotational speed of the drive roller, the controller comprising:

a first input that receives the mark signal from the mark sensor;

a second input that receives the pulse from the transducer;

the controller being constructed and arranged to compare the mark sensor signal to the movement signal and thereby generate a control signal; and an output for transmitting the control signal to the registration controller motor to, thereby selectively operate the registration controller motor to vary the drive roller rotational speed to maintain a desired rate of passage of pinless continuous web into the utilization device element.

23. The controller as set forth in claim 22 wherein the tractor pin feed system further includes an upper tractor pin feed unit downstream of the utilization device element including opposing moving tractor pin feed strips each having sets of pins located outwardly of opposing side edges of the pinless continuous web.

24. The controller as set forth in claim 22 further comprising at least one pair of stiffener bars defining a web guiding gap therebetween located upstream of the drive roller.

25. The controller as set forth in claim 22 further comprising an idler roller mounted on a movable bracket constructed and arranged to be selectively biased against and located out of pressurable engagement with the drive roller.

26. The controller as set forth in claim 22 wherein the tractor pin feed strips of the lower tractor pin feed unit each include movable covers constructed and arranged to respectively overlie each of the tractor pin feed strips of the lower tractor pin feed unit at selected times that respectively maintain the opposing side edges of the pinless continuous web in engagement with the pin feed strips.

27. The controller as set forth in claim 26 wherein the drive roller includes a drive surface located remote from a plane defined by the tractor pin feed strips of the lower tractor pin feed unit, and wherein the tractor pin feed strips each engage the pinless continuous web adjacent opposing side edges thereof.

* * * * *